US008717244B2

(12) United States Patent
Joyce, Jr. et al.

(10) Patent No.: US 8,717,244 B2
(45) Date of Patent: May 6, 2014

(54) RFID TAG WITH A MODIFIED DIPOLE ANTENNA

(75) Inventors: Terrence H. Joyce, Jr., Lakeville, MN (US); Swagata R. Banerjee, North Oaks, MN (US); William C. Egbert, Minneapolis, MN (US); Katherine A. Brown, Lake Elmo, MN (US); Jaewon Kim, Roseville, MN (US); William A. Mittelstadt, Woodbury, MN (US); Robert A. Sainati, Bloomington, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 1005 days.

(21) Appl. No.: 11/870,789

(22) Filed: Oct. 11, 2007

(65) Prior Publication Data

US 2009/0096696 A1 Apr. 16, 2009

(51) Int. Cl.
*H01Q 9/28* (2006.01)

(52) U.S. Cl.
USPC ..... 343/795

(58) Field of Classification Search
USPC ..... 343/793, 795, 700 MS; 340/572.7, 340/572.1, 572.5; 235/492
See application file for complete search history.

(56) References Cited

U.S. PATENT DOCUMENTS 4,853,705 A 8/1989 Landt
5,182,570 A 1/1993 Nysen et al.
5,465,099 A 11/1995 Mitsui et al.
5,528,222 A 6/1996 Moskowitz et al.
5,574,470 A 11/1996 de Vall
5,771,021 A 6/1998 Veghte et al.
5,929,812 A 7/1999 Aminzadeh
5,943,022 A 8/1999 Massey
5,963,134 A 10/1999 Bowers et al.

(Continued)

FOREIGN PATENT DOCUMENTS

DE 101 36 502 A1 2/2003
EP 0 274 592 A1 7/1988

(Continued)

OTHER PUBLICATIONS

Product Literature: Alien Squiggle® Family of EPC RFID Tags, Alien, Class 1 Gen 1 and Gen 2 Tagging Solutions, 2 pages (date unknown but believed to be prior to the date of the filing of the present application).

(Continued)

*Primary Examiner* — Robert Karacsony

(57) ABSTRACT

In general, the disclosure describes an RFID tag designed such that the tag is both covert and not easily blocked from the interrogation signal by the hand or other body part of a person. In particular, the RFID tag is designed to have a long, narrow aspect that allows placement of the tag in locations on or in a book that are inconspicuous to the casual observer while extending beyond a hand of a person holding the book by the spine on or near a geometry centerline. The RFID tag includes a dipole segment and a loop segment coupled to the dipole segment. The loop segment of the modified dipole antenna provides the antenna with larger signal strength than conventional dipole antennas. Moreover, the conductive loop segment also provides improved impedance matching capabilities to allow the modified dipole antenna to match the impedance of an integrated circuit (IC) chip of the RFID tag.

25 Claims, 18 Drawing Sheets

(56) References Cited

U.S. PATENT DOCUMENTS

| | | | | |
|---|---|---|---|---|
| 6,031,505 | A | 2/2000 | Qi et al. | |
| 6,037,879 | A | 3/2000 | Tuttle | |
| 6,100,804 | A | 8/2000 | Brady et al. | |
| 6,118,379 | A | 9/2000 | Kodukula et al. | |
| 6,130,612 | A | 10/2000 | Castellano et al. | |
| 6,147,605 | A | 11/2000 | Vega et al. | |
| 6,147,655 | A | 11/2000 | Roesner | |
| 6,181,287 | B1 | 1/2001 | Beigel | |
| 6,184,834 | B1 | 2/2001 | Utsumi et al. | |
| 6,232,870 | B1 | 5/2001 | Garber et al. | |
| 6,239,753 | B1 | 5/2001 | Kado et al. | |
| 6,265,977 | B1 | 7/2001 | Vega et al. | |
| 6,285,342 | B1 | 9/2001 | Brady et al. | |
| 6,304,169 | B1 | 10/2001 | Blama et al. | |
| 6,329,951 | B1 | 12/2001 | Wen et al. | |
| 6,366,260 | B1 | 4/2002 | Carrender | |
| 6,384,727 | B1 | 5/2002 | Diprizio et al. | |
| 6,459,588 | B1 | 10/2002 | Morizumi et al. | |
| 6,466,131 | B1 | 10/2002 | Tuttle et al. | |
| 6,480,110 | B2 | 11/2002 | Lee et al. | |
| 6,486,780 | B1 | 11/2002 | Garber et al. | |
| 6,501,435 | B1 | 12/2002 | King et al. | |
| 6,522,308 | B1 | 2/2003 | Mathieu | |
| 6,630,910 | B2 | 10/2003 | Forster et al. | |
| 6,657,592 | B2 | 12/2003 | Dening et al. | |
| 6,727,855 | B1 | 4/2004 | Nalbandian | |
| 6,853,345 | B2 | 2/2005 | King et al. | |
| 6,862,004 | B2 | 3/2005 | Alexopoulos et al. | |
| 6,903,656 | B1 | 6/2005 | Lee | |
| 6,950,071 | B2 | 9/2005 | Wen et al. | |
| 6,956,472 | B1 | 10/2005 | Walcott, Jr. et al. | |
| 7,123,151 | B2 | 10/2006 | Garber et al. | |
| 7,151,497 | B2 | 12/2006 | Crystal | |
| 7,164,380 | B2 | 1/2007 | Saito | |
| 7,221,269 | B2 | 5/2007 | Onderko et al. | |
| 7,277,017 | B2 | 10/2007 | Baba et al. | |
| 7,319,398 | B2 | 1/2008 | Marino | |
| 7,336,243 | B2 * | 2/2008 | Jo et al. | 343/895 |
| 7,443,300 | B2 | 10/2008 | Tessier | |
| 7,486,192 | B2 * | 2/2009 | Yamagajo et al. | 340/572.7 |
| 7,525,487 | B2 | 4/2009 | Burnside et al. | |
| 7,619,529 | B2 | 11/2009 | Goff et al. | |
| 7,619,530 | B2 * | 11/2009 | Kawamata | 340/572.7 |
| 7,648,065 | B2 | 1/2010 | Marino | |
| 7,659,863 | B2 | 2/2010 | Kai et al. | |
| 2002/0003496 | A1 | 1/2002 | Brady et al. | |
| 2003/0091789 | A1 | 5/2003 | Koskenmaki et al. | |
| 2004/0056823 | A1 | 3/2004 | Zuk et al. | |
| 2004/0217865 | A1 | 11/2004 | Turner | |
| 2005/0024287 | A1 | 2/2005 | Jo et al. | |
| 2005/0197074 | A1 | 9/2005 | Cullen et al. | |
| 2005/0212707 | A1 | 9/2005 | Egbert et al. | |
| 2006/0043199 | A1 | 3/2006 | Baba et al. | |
| 2006/0044192 | A1 | 3/2006 | Egbert | |
| 2006/0139172 | A1 | 6/2006 | Waldner et al. | |
| 2006/0164247 | A1 | 7/2006 | Overhultz et al. | |
| 2006/0208955 | A1 | 9/2006 | Kai et al. | |
| 2006/0214801 | A1 | 9/2006 | Murofushi et al. | |
| 2006/0238307 | A1 | 10/2006 | Bauer et al. | |
| 2006/0244604 | A1 | 11/2006 | Sakama et al. | |
| 2006/0258327 | A1 | 11/2006 | Lee et al. | |
| 2007/0046475 | A1 | 3/2007 | Carrender | |
| 2007/0075911 | A1 | 4/2007 | Yaginuma et al. | |
| 2007/0176839 | A1 * | 8/2007 | Kai et al. | 343/803 |
| 2007/0200782 | A1 | 8/2007 | Hayama et al. | |
| 2009/0237319 | A1 | 9/2009 | Fukushima et al. | |

FOREIGN PATENT DOCUMENTS

| | | | |
|---|---|---|---|
| EP | 0 969 547 | A2 | 1/2000 |
| EP | 1 026 779 | A2 | 8/2000 |
| EP | 1710734 | | 10/2006 |
| EP | 1739597 | A2 | 1/2007 |
| GB | 2 260 065 | A | 9/1992 |
| JP | 52-052549 | | 4/1977 |
| JP | 03-135697 | | 6/1991 |
| JP | 2001-225921 | | 8/2001 |
| JP | 2002-060021 | | 2/2002 |
| JP | 2006235946 | A | 9/2006 |
| JP | 2007-070112 | | 3/2007 |
| JP | 2007-104413 | | 4/2007 |
| WO | WO 99/65002 | | 12/1999 |
| WO | WO 00/10122 | | 2/2000 |
| WO | WO 00/21030 | | 4/2000 |
| WO | WO 00/26993 | | 5/2000 |
| WO | WO 00/59067 | | 10/2000 |
| WO | WO 01/67384 | A1 | 9/2001 |
| WO | WO 03/044892 | | 5/2003 |
| WO | WO 2005/022690 | A1 | 3/2005 |
| WO | WO 2006/021914 | A1 | 3/2006 |
| WO | WO 2006/050412 | | 5/2006 |

OTHER PUBLICATIONS

"Attenuators", Agilent Technologies, pp. 39-53, website: www.agilent.com/find/accessories (date unknown but believed to be prior to the date of the filing of the present application).

Product Data Sheet: Circularly Polarized Panel Antenna for ISM Band, Communications Antennas, Cushcraft Corporation, 1 page, website: www.cushcraft.com (date unknown but believed to be prior to the date of the filing of the present application).

Product Literature: Cuming Microwave, C-RAM SFC, Technical Bulletin 390-1, Document Control No. N-15-000-0088-J, 2 pages, Jun. 15, 2007.

Multek Flexible Circuits, Inc., Flexible Circuit Design Guidelines, Document DG 01 Rev. C, 9 pages, Jan. 2005.

Product Literature: Impinj®, UHF Gen 2 RFID Tag Silicon, 1 page, website: www.impinj.com. (date unknown but believed to be prior to the date of the filing of the present application).

Technical Information Sheet: Loctite®, Product 3447, Henkel Loctite Corporation, Jun. 2003.

Product Literature: MP9320, v2.8 EPC UHF RFID Reader, SAMSys, Inc., 2 pages (date unknown but believed to be prior to the date of the filing of the present application).

Product Literature: RSI ID Technologies, IN-64, 1 page (date unknown but believed to be prior to the date of the filing of the present application).

Product Literature: What is STYROFOAM?, The Dow Chemical Company, 2 pages, website: http://building.dow.com/styrofoam/what.htm (printed Mar. 26, 2008).

Shortley et al., "Elements of Physics", Prentice-Hall, Inc., Englewood Cliffs, NJ, 1971, pp. 690-693.

Horowitz et al., "The Art of Electronics", Cambridge University Press, Cambridge, England, 1980, pp. 29, 565-568.

Morrow et al., "Rolled Edge Ultra-wideband Dipole Antenna for GPR Application", IEEE Antennas and Propagation Society International Symposium, 2002 Digest, Jun. 16-21, 2002, New York, NY, vol. 1 of 4, Jun. 16, 2002, pp. 484-487.

C.C. Chiau, "A Miniature Dielectric-Loaded Folded Half-Loop Antenna and Ground Plane Effects", IEEE Antennas and Wireless Propagation Letters, vol. 4, 2005, pp. 459-462.

Product Literature: Sirit vision beyond sight™, Infinity 510, Ultra High Frequency 860-960 $MH_z$ High-Performance, Ulti-Protocol Reader, 2 pages (date unknown but believed to be prior to the date of the filing of the present application).

Product Literature: 3M "Tattle-Tape" Security Strips & Applicators, 1 page (date unknown but believed to be prior to the date of the filing of the present application).

Product Literature: Avery Dennison, Avery Dennison AD-220 RFID Dry Inlay and Labels, 7 pages, http://www.racoindustries.com/avad220.htm, printed May 27, 2008.

Kleist et al., RFID Labeling, "Smart Labeling Concepts & Applications for the Consumer Packaged Goods Supply Chain", Printronix, Inc., 211 pp., ISBN-0-9760086-0-2 (2004).

U.S. Appl. No. 11/838,356, filed Aug. 14, 2007, "RFID Tag Including a Three-Dimensional Antenna".

(56) References Cited

OTHER PUBLICATIONS

U.S. Appl. No. 11/904,625, filed Sep. 27, 2007, "Extended RFID Tag".

U.S. Appl. No. 11/904,616, filed Sep. 27, 2007, "Signal Line Structure for a Radio-Frequency Identification System".

International Search Report for International Application No. PCT/US2008/078308.

* cited by examiner

RFID TAG WITH A MODIFIED DIPOLE ANTENNA

TECHNICAL FIELD

This disclosure relates to radio frequency identification (RFID) systems for article management and, more specifically, to RFID tags.

BACKGROUND

Radio-Frequency Identification (RFID) technology has become widely used in virtually every industry, including transportation, manufacturing, waste management, postal tracking, airline baggage reconciliation, and highway toll management. RFID systems are often used to prevent unauthorized removal of articles from a protected area, such as a library or retail store.

An RFID system often includes an interrogation zone or corridor located near the exit of a protected area for detection of RFID tags attached to the articles to be protected. Each tag usually includes information that uniquely identifies the article to which it is affixed. The article may be a book, a manufactured item, a vehicle, an animal or individual, or virtually any other tangible article. Additional data as required by the particular application may also be provided for the article.

To detect a tag, the RF reader outputs RF signals through an antenna to create an electromagnetic field within the interrogation corridor. The field activates tags within the corridor. In turn, the tags produce a characteristic response. In particular, once activated, the tags communicate using a pre-defined protocol, allowing the RFID reader to receive the identifying information from one or more tags in the corridor. If the communication indicates that removal of an article has not been authorized, the RFID system initiates some appropriate security action, such as sounding an audible alarm, locking an exit gate or the like.

SUMMARY

In general, the disclosure describes an RFID tag designed such that the tag is both covert and not easily blocked from the interrogation signal by the hand or other body part of a person. In particular, the RFID tag is designed to have a long, narrow aspect that allows placement of the tag in locations on or in a book that are inconspicuous to the casual observer while extending beyond a hand of a person holding the book by the spine on or near a geometry centerline. In accordance with the techniques of this disclosure the UHF RFID tag may be less than about 10 mm (approximately 0.4 inches) wide and greater than about 100 mm (approximately 4 inches) long. More preferably, a UHF RFID tag designed in accordance with this disclosure would have a width of less than about 7 mm (approximately 0.3 inches) and a length between about 125 mm and 140 mm (approximately 5 to 5.5 inches), and even more preferably between about 130 mm and 135 mm. In this manner, the width of the UHF RFID tags described herein allows the tags to be placed in locations that make the tag inconspicuous to the casual observer, e.g., in the gutter or spine of a book, while the length of the UHF RFID tags allows the tags to be interrogated even when partially covered by the hand of a person.

In one embodiment, a dipole antenna for a radio frequency identification (RFID) tag includes a straight dipole segment formed from a first electrically conductive trace and a loop segment formed from a second electrically conductive trace and electrically coupled to the straight dipole segment. A width of the dipole antenna is less than or equal to four times a width of a smaller one of the first and second conductive traces.

In another embodiment, a radio frequency identification (RFID) tag comprises a modified dipole antenna and an integrated circuit electrically coupled to the modified dipole antenna. The modified dipole antenna includes a straight dipole segment formed from a first electrically conductive trace and a loop segment formed from a second electrically conductive trace and electrically coupled to the straight segment. A width of the modified dipole antenna is less than approximately 6 millimeters (mm) and a length of the modified dipole antenna is greater than approximately 100 mm; and The details of one or more embodiments are set forth in the accompanying drawings and the description below. Other features, objects, and advantages of the embodiments will be apparent from the description and drawings, and from the claims.

DETAILED DESCRIPTION

Figure 1:
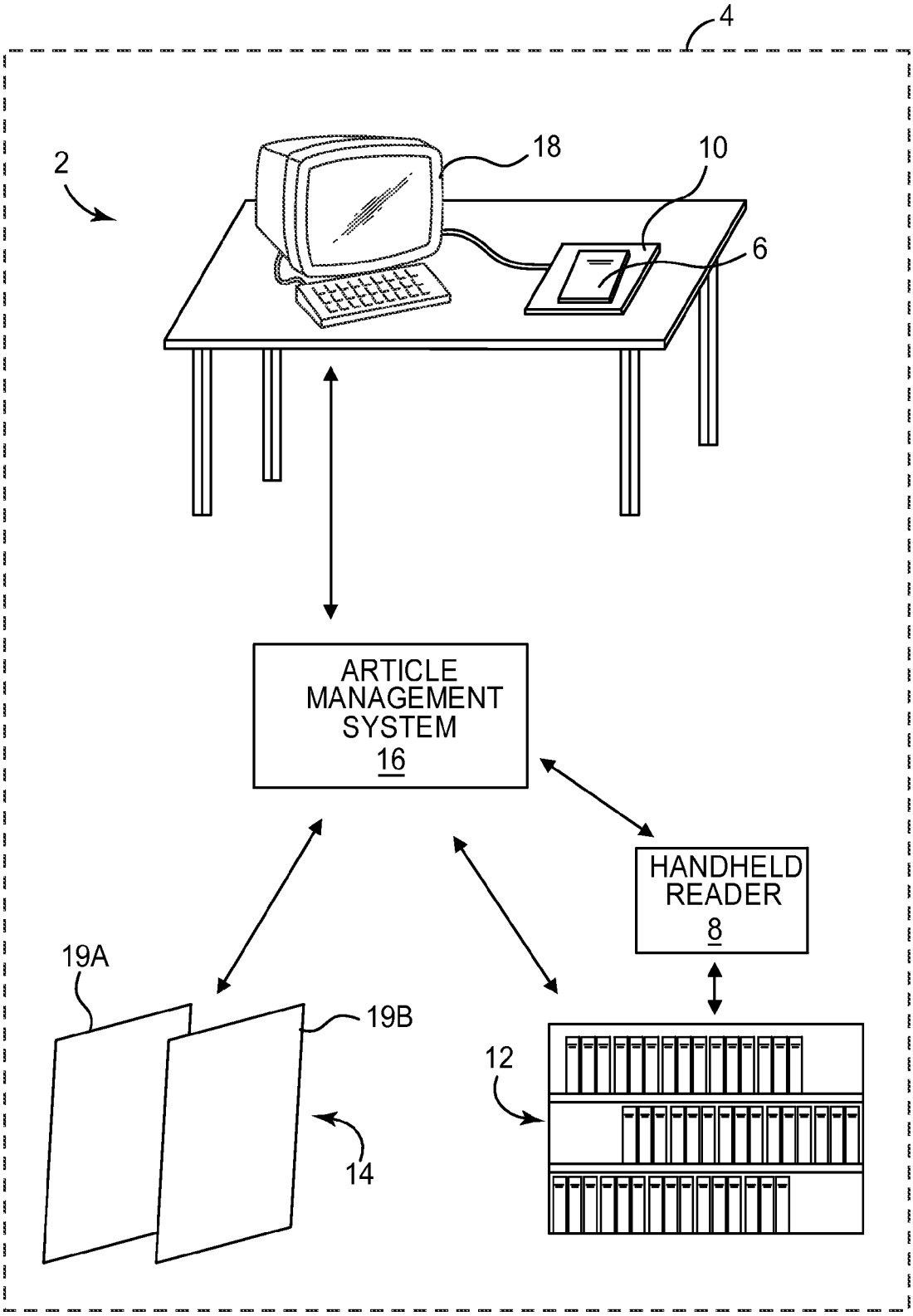
FIG. 1 is a block diagram illustrating a radio frequency identification (RFID) system for managing a plurality of articles.

RFID systems configured to operate in an ultra high frequency (UHF) band of the RF spectrum, e.g., between 300 MHz and 3 GHz, may provide several advantages including, increased read range and speed, lower tag cost, smaller tag sizes and the like. However, signals in the UHF band may be subject to attenuation from objects located between the interrogation device and the RFID tag. In particular, the attenuation from objects located between the interrogation device and the RFID tag may result in a decreased signal strength that is not sufficient for interrogation. For example, a person's hand or other body part may block the interrogation signal so that it does not reach the RFID tag or reaches the RFID tag with insufficient strength.

Conventional UHF RFID tag designs typically fall into one of two categories; covert tags that are small tags that are difficult if not impossible to locate by simple inspection and larger tags that are easily located. Conventional covert tags are typically less than approximately 100 mm (about 4 inches) long and at least approximately 13 mm (about ½ inch) wide. Such dimensions make conventional UHF RFID tags particularly susceptible to blockage, e.g., by a person's hand. For a tag placed in a gutter (area near the spine where one edge of each page is bound into the binding of a book) or spine of a book, one hand over the spine of the book can block the tag such that it may not be interrogated. Therefore, a person may inadvertently, or purposefully, cover the RFID tag with their hand to block the interrogation signal from being received, thus allowing for unauthorized removal of the article from a protected area. Larger conventional RFID tags, on the other hand, are not easily blocked from the interrogation signal. However, the larger RFID tags are placed in or on the book in locations that are easy to locate. Thus, the larger conventional RFID tags are susceptible to physical removal from the article to which it is attached.

An RFID tag designed in accordance with the techniques described herein includes a modified dipole antenna formed from a dipole antenna segment coupled to a conductive loop segment. As described in detail below, the conductive loop segment of the modified dipole antenna provides the antenna with larger signal strength than conventional dipole antennas. Moreover, the conductive loop segment also provides improved impedance matching capabilities to allow the modified dipole antenna to match the impedance of an integrated circuit (IC) chip of the RFID tag.

The RFID tag and the modified dipole antenna designed in accordance with the techniques described herein provides a tag that is both covert and not easily blocked from the interrogation signal by the hand or other body part of a person. In particular, the RFID tag has a long, narrow aspect that allows placement of the tag in locations on or in a book that are inconspicuous to the casual observer while extending beyond a hand of a person holding the book by the spine on or near a geometry centerline. In accordance with the techniques of this disclosure the UHF RFID tag may be less than about 10 mm (approximately 0.4 inches) wide and greater than about 100 mm (approximately 4 inches) long. More preferably, a UHF RFID tag designed in accordance with this disclosure would have a width of less than about 7 mm (approximately 0.3 inches), and even more preferably less than about 4 mm (approximately 0.15 inches). The length of the UHF RFID tag is more preferably between about 125 mm and 140 mm (approximately 5 to 5.5 inches), and even more preferably between about 130 mm and 135 mm. In this manner, the width of the UHF RFID tags described herein allows the tags to be placed in locations that make the tag inconspicuous to the casual observer, e.g., in the gutter or spine of a book, while the length of the UHF RFID tags allows the tags to be interrogated even when partially covered by the hand of a person.

FIG. 1 is a block diagram illustrating a radio frequency identification (RFID) system 2 for managing a plurality of articles. In the example illustrated in FIG. 1, RFID system 2 manages a plurality of articles within a protected area 4. For purposes of the present description, the protected area will be assumed to be a library and the articles will be assumed to be books or other articles to be checked out. Although the system will be described with respect to detecting checked-in RFID tags to prevent the unauthorized removal of articles from a facility, it shall be understood that the techniques of this disclosure are not limited in this respect. For example, RFID system 2 could also be used to determine other kinds of status or type information without departing from the scope of this disclosure. Moreover, the techniques described herein are not dependent upon the particular application in which RFID system 2 is used. RFID system 2 may be used to manage articles within a number of other types of protected environments. RFID system 2 may, for example, be used to prevent unauthorized removal of articles from, or to simply track articles within, a corporation, a law firm, a government agency, a hospital, a bank, a retail store or other facility.

Each of the articles within protected area 4, such as book 6, may include an RFID tag (not shown in FIG. 1) attached to the respective article. The RFID tags may be attached to the articles with a pressure sensitive adhesive, tape or any other suitable means of attachment. The placement of RFID tags on the respective articles enables RFID system 2 to associate a description of the article with the respective RFID tag via radio frequency (RF) signals. For example, the placement of the RFID tags on the articles enables one or more interrogation devices of RFID system 2 to associate a description or other information related to the article. In the example of FIG. 1, the interrogation devices of RFID system 2 include a handheld RFID reader 8, a desktop reader 10, a shelf reader 12 and an exit control system 14. Handheld RFID reader 8, desktop reader 10, shelf reader 12 and exit control system 14 (collectively referred to herein as "the interrogation devices") may interrogate one or more of the RFID tags attached to the articles by generating and transmitting RF interrogation signals to the respective tags via an antenna.

An RFID tag receives the interrogation signal from one of the interrogation devices via an antenna disposed within or otherwise coupled to the RFID tag. If a field strength of the interrogation signal exceeds a read threshold, the RFID tag is energized and responds by radiating an RF response signal. That is, the antenna of the RFID tag enables the tag to absorb energy sufficient to power an IC chip coupled to the antenna. Typically, in response to one or more commands contained in the interrogation signal, the IC chip drives the antenna of the RFID tag to output the response signal to be detected by the respective interrogation device. The response signal may include information about the RFID tag and its associated article. In this manner, interrogation devices interrogate the RFID tags to obtain information associated with the articles, such as a description of the articles, a status of the articles, a location of the articles, or the like.

Desktop reader 10 may, for example, couple to a computing device 18 for interrogating articles to collect circulation information. A user (e.g., a librarian) may place an article, e.g., book 6, on or near desktop reader 10 to check-out book 6 to a customer or to check-in book 6 from a customer. Desktop reader 10 interrogates the RFID tag of book 6 and provides the information received in the response signal from the RFID tag of book 6 to computing device 18. The information may, for example, include an identification of book 6 (e.g., title, author, or book ID number), a date on which book 6 was checked-in or checked-out, and a name of the customer to whom the book was checked-out. In some cases, the customer may have an RFID tag (e.g., badge or card) associated with the customer that is scanned in conjunction with, prior to or subsequent to the articles which the customer is checking out.

As another example, the librarian may use handheld reader 8 to interrogate articles at remote locations within the library, e.g., on the shelves, to obtain location information associated with the articles. In particular, the librarian may walk around the library and interrogate the books on the shelves with handheld reader 8 to determine what books are on the shelves. The shelves may also include an RFID tag that may be interrogated to indicate which shelves particular books are on. In some cases, handheld reader 8 may also be used to collect circulation information. In other words, the librarian may use handheld reader 8 to check-in and check-out books to customers.

Shelf reader 12 may also interrogate the books located on the shelves to generate location information. In particular, shelf reader 12 may include antennas along the bottom of the shelf or on the sides of the shelf that interrogate the books on the shelves of shelf reader 12 to determine the identity of the books located on the shelves. The interrogation of books on shelf reader 12 may, for example, be performed on a weekly, daily or hourly basis.

The interrogation devices may interface with an article management system 16 to communicate the information collected by the interrogations to article management system 16. In this manner, article management system 16 functions as a centralized database of information for each article in the facility. The interrogation devices may interface with article management system 16 via one or more of a wired interface, a wireless interface, or over one or more wired or wireless networks. As an example, computing device 18 and/or shelf reader 12 may interface with article management system 16 via a wired or wireless network (e.g., a local area network (LAN)). As another example, handheld reader 8 may interface with article management system 16 via a wired interface, e.g., a USB cable, or via a wireless interface, such as an infrared (IR) interface or Bluetooth™ interface.

Article management system 14 may also be networked or otherwise coupled to one or more computing devices at various locations to provide users, such as the librarian or customers, the ability to access data relative to the articles. For example, the users may request the location and status of a particular article, such as a book. Article management system 14 may retrieve the article information from a database, and report to the user the last location at which the article was located or the status information as to whether the article has been checked-out. In this manner, RFID system 2 may be used for purpose of collection cataloging and circulating information for the articles in protected area 4.

In some embodiments, an interrogation device, such as exit control system 14, may not interrogate the RFID tags to collect information, but instead to detect unauthorized removal of the articles from protected area 4. Exit control system 14 may include lattices 19A and 19B (collectively, "lattices 19") which define an interrogation zone or corridor located near an exit of protected area 4. Lattices 19 include one or more antennas for interrogating the RFID tags as they pass through the corridor to determine whether removal of the article to which the RFID tag is attached is authorized. If removal of the article is not authorized, e.g., the book was not checked-out properly, exit control system 14 initiates an appropriate security action, such as sounding an audible alarm, locking an exit gate or the like.

RFID system 2 may be configured to operate in an ultra high frequency (UHF) band of the RF spectrum, e.g., between 300 MHz and 3 GHz. In one exemplary embodiment, RFID system 2 may be configured to operate in the UHF band from approximately 902 MHz to 928 MHz. RFID system 2 may, however, be configured to operate within other portions of the UHF band, such as around 868 MHz (i.e., the European UHF band) or 955 MHz (i.e., the Japanese UHF band). Operation within the UHF band of the RF spectrum may provide several advantages including, increased read range and speed, lower tag cost, smaller tag sizes and the like. However, signals in the UHF band may be subject to attenuation from objects located between the interrogation device and the RFID tag. In particular, the attenuation from objects located between the interrogation device and the RFID tag may result in a decreased signal strength that is not sufficient for interrogation. For example, a person's hand or other body part may block the interrogation signal so that it does not reach the RFID tag or reaches the RFID tag with insufficient strength.

Conventional UHF RFID tag designs typically fall into one of two categories; covert tags that are small tags that are difficult if not impossible to locate by simple inspection and larger tags that are easily located. Conventional covert tags are typically less than approximately 100 mm (about 4 inches) long and at least approximately 13 mm (about ½ inch) wide. Such dimensions make conventional UHF RFID tags particularly susceptible to blockage, e.g., by a person's hand. For a tag placed in a gutter (area near the spine where one edge of each page is bound into the binding of a book) or spine of a book, one hand over the spine of the book can block the tag such that it may not be interrogated. Therefore, a person may inadvertently, or purposefully, cover the RFID tag with their hand to block the interrogation signal from being received, thus allowing for unauthorized removal of the article from protected area 4. Larger conventional RFID tags, on the other hand, are not easily blocked from the interrogation signal. However, the larger RFID tags are placed in or on the book in locations that are easy to locate. Thus, the larger conventional RFID tags are susceptible to physical removal from the article to which it is attached.

An RFID tag designed in accordance with the techniques described herein provides a tag that is both covert and not easily blocked from the interrogation signal by the hand or other body part of a person. In particular, the RFID tag has a long, narrow aspect that allows placement of the tag in locations on or in a book that are inconspicuous to the casual observer while extending beyond a hand of a person holding the book by the spine on or near a geometry centerline. In accordance with the techniques of this disclosure the UHF RFID tag may be less than about 10 mm (approximately 0.4 inches) wide and greater than about 100 mm (approximately 4 inches) long. More preferably, a UHF RFID tag designed in accordance with this disclosure would have a width of less than about 7 mm (approximately 0.3 inches), and even more preferably less than about 4 mm (approximately 0.15 inches).

The length of the UHF RFID tag is more preferably between about 125 mm and 140 mm (approximately 5 to 5.5 inches), and even more preferably between about 130 mm and 135 mm. In this manner, the width of the UHF RFID tags described herein allows the tags to be placed in locations that make the tag inconspicuous to the casual observer, e.g., in the gutter or spine of a book, while the length of the UHF RFID tags allows the tags to be interrogated even when partially covered by the hand of a person.

Figure 2A:
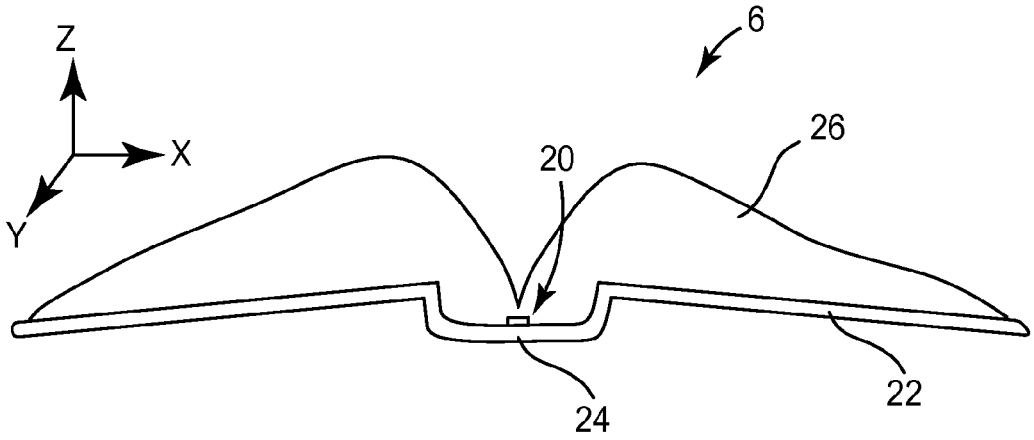
FIGS. 2A and 2B are schematic diagrams illustrating an RFID tag attached to an article.
Figure 2B:
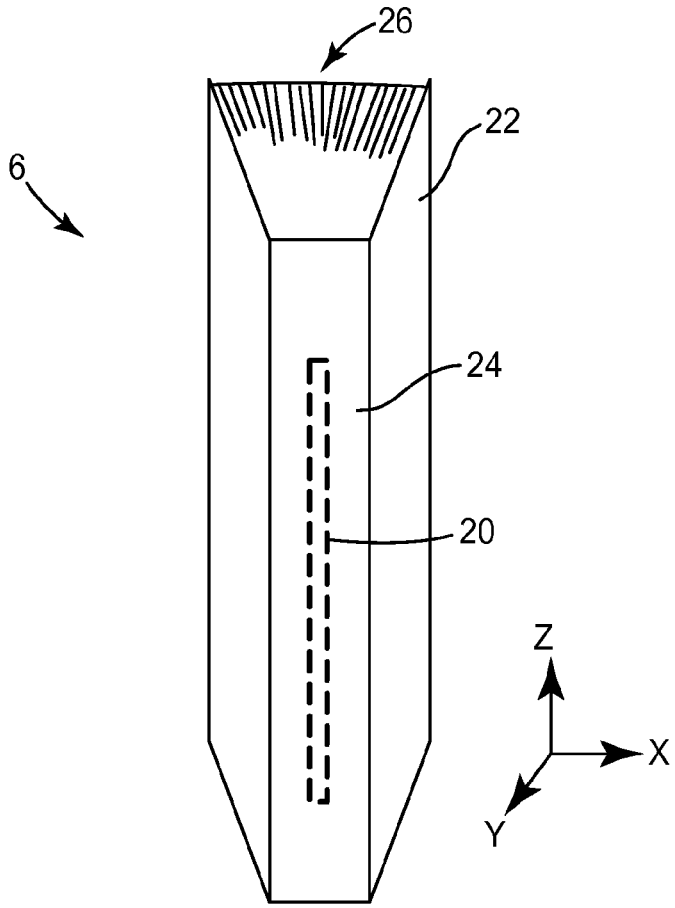

FIGS. 2A and 2B are schematic diagrams illustrating an RFID tag 20 attached to an article. In the example of FIGS. 2A and 2B, the article is a book 6. Book 6 includes a cover 22, a spine 24 and a plurality of pages 26. Cover 22 may be a hard cover or a soft cover. Spine 24 is typically constructed of a similar material as cover 22. In the example illustrated in FIG. 2, RFID tag 20 is placed within book 6 on an inside portion of spine 24. RFID tag 20 may be attached to the inside portion of spine 24 with a pressure sensitive adhesive, tape or any other suitable means of attachment. For example, RFID tag 20 may include an adhesive layer on one or both sides that may be attached to spine 24. RFID tag 20 may be placed on the inside portion of spine 24 during production of the book or after production, e.g., post purchase.

RFID tag 20 has dimensions that allow the tag to be both covert and not easily blocked from an interrogation signal by the hand or other body part of a person. RFID tag 20 has a width that permits RFID tag 20 to be placed covertly along the inside portion of spine 24 of most books, even books with relatively few pages. As described above, RFID tag 20 may have a width in the x-direction of less than 10 mm (less than approximately 0.4 inches), and more preferably a width of less than 7 mm and even more preferably a width of less than approximately 4 mm. RFID tag 20 has a length in the y-direction that permits RFID tag 20 to be interrogated even when a hand of a person is placed over spine 24 of book 6. In other words, the length of the RFID tag 20 is configured such that an antenna of RFID tag 20 extends beyond the hand of an average-sized person holding the book by the spine on or near a geometric centerline of book 6, thus preventing blocking of the interrogation signal to RFID tag 20. In this manner, RFID tag 20 may be activated by exit control system 14 when not properly checked out, thus serving as a theft deterrent. As described above, RFID tag 20 may have a length of greater than 100 mm (approximately 4 inches), and more preferably between 125 mm and 140 mm (approximately 5 to 5.5 inches), and even more preferably between 130 mm and 135 mm.

RFID tag 20 may further serve as an electronic label for identification purposes such as for collecting cataloguing and circulating (check-out and check-in) information for book 6, location information for book 6 or other identification and/or status information associated with book 6. In other words, RFID tag 20 may also be interrogated by other interrogation readers, such as handheld reader 8, desktop reader 10, and shelf reader 12 to collect additional information. Although RFID tag 20 of FIGS. 2A and 2B is shown attached to book 6, RFID tag 20 may be attached to other articles that may be located within library, such as magazines, files, laptops, CDs and DVDs. Moreover, RFID tag 20 may be used for detecting unauthorized removal of other articles from different facilities, such as corporations, law firms, government agencies, hospitals, banks, retail stores or other facilities.

Figure 3A:
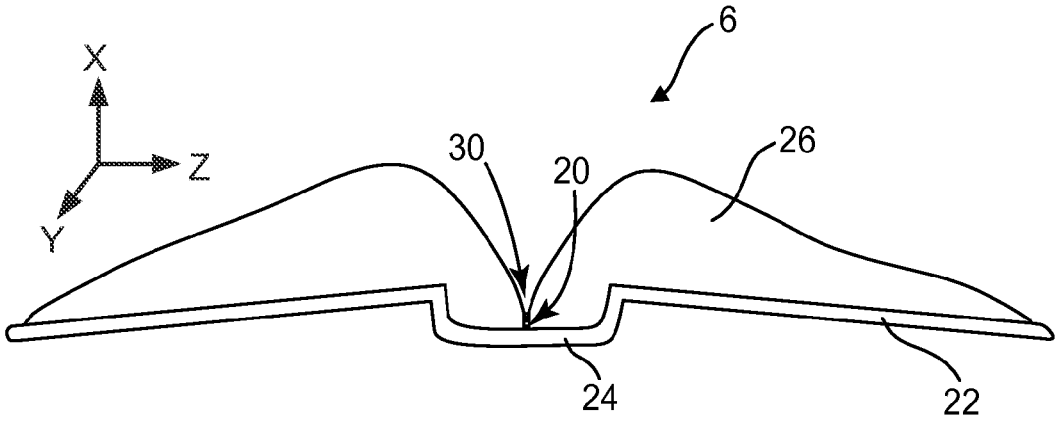
FIGS. 3A and 3B are schematic diagrams illustrating an RFID tag attached to an article.
Figure 3B:
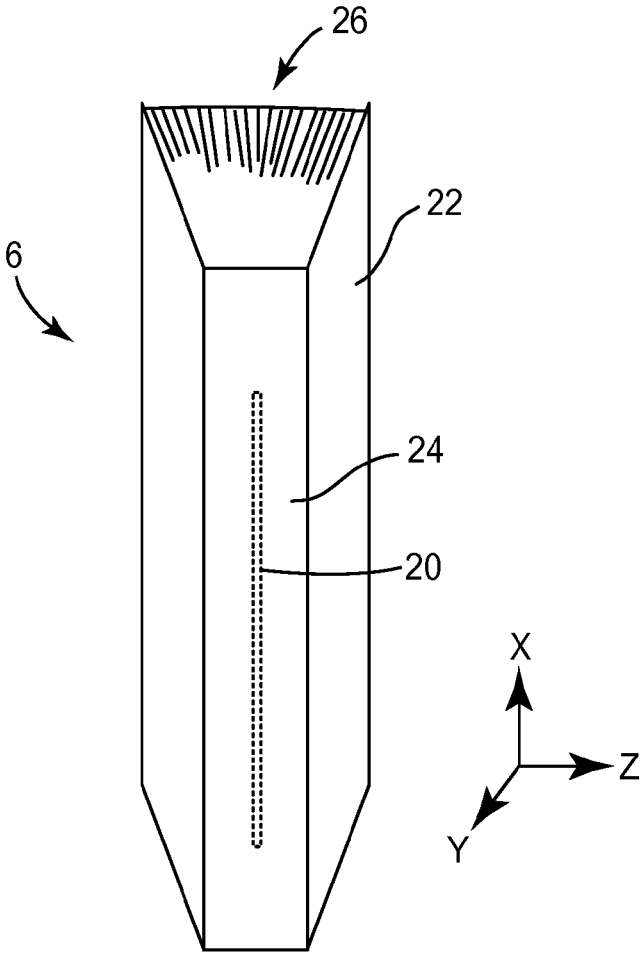

FIGS. 3A and 3B are schematic diagrams illustrating an RFID tag 20 attached to an article. Like FIGS. 2A and 2B, the article illustrated in FIGS. 3A and 3B is a book 6. RFID tag 20 may, however, be attached to a number of different articles such as CDs, DVDs, clothing, pictures, files, laptops or the like. The schematic diagrams of FIGS. 3A and 3B conform substantially with those of FIGS. 2A and 2B, except RFID tag 20 of FIGS. 3A and 3B is located within a gutter 30 of book 6. Gutter 30 is an area near spine 24 of book 6 where one edge of each of the plurality of pages 26 of book 6 is bound into the binding of book 6. RFID tag 20 is placed in gutter 30 near spine 24 of book 6. RFID tag 20 may, for example, be placed inside gutter 30 between two pages and attach to one or both of the pages at the bottom of gutter 30. As described above, RFID tag 20 may attach to the pages in gutter 30 via a pressure sensitive adhesive, tape or any other suitable means of attachment. For example, RFID tag 20 may include an adhesive layer on one or both sides that may be attached to spine 24. As described above, RFID tag 20 has dimensions that allow RFID tag 20 to be: (1) covert and (2) not easily blocked from an interrogation signal by the hand or other body part of a person.

Figure 4:
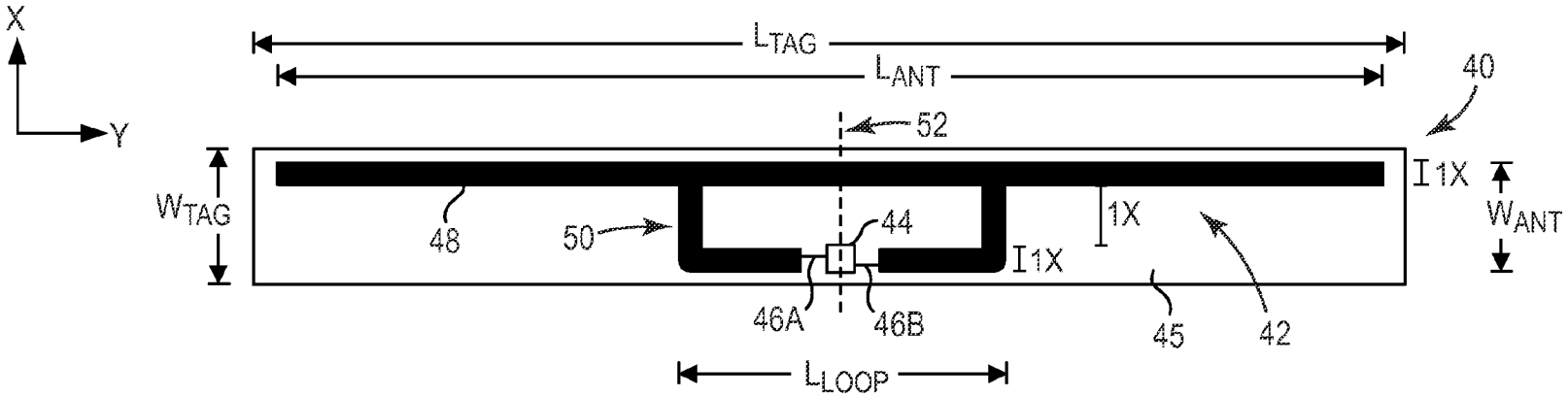
FIG. 4 is a schematic diagram illustrating an exemplary RFID tag with a modified dipole antenna.

FIG. 4 is a schematic diagram illustrating an exemplary UHF RFID tag 40 with a modified dipole antenna 42. Modified dipole antenna 42 is coupled to an IC chip 44 on a substrate 45. Modified dipole antenna 42 may be electrically coupled to IC chip 44 via feed points 46A and 46B (collectively, "feed points 46"). In one embodiment, modified dipole antenna 42 may be located on a first side of substrate 45 and IC chip 44 may be located on a second side of substrate 45. In this case, feed points 46 may electrically couple modified dipole antenna 42 to IC chip 44 using one or more vias or crossovers that extend through substrate 45. In another embodiment, a first portion of modified dipole antenna 42 may be located on the first side of substrate 45 and a second portion of modified dipole antenna 42 may be located on the second side of substrate 45 along with IC chip 44. Alternatively, modified dipole antenna 42 and IC chip 44 may be located on the same side of substrate 45.

IC chip 44 may be embedded within RFID tag 40 or mounted as a surface mounted device (SMD). IC chip 44 may include firmware and/or circuitry to store within RFID tag 40 unique identification and other desirable information, interpret and process commands received from the interrogation hardware, respond to requests for information by an interrogation device and to resolve conflicts resulting from multiple tags responding to interrogation simultaneously. Optionally, IC chip 44 may be responsive to commands (e.g., read/write commands) for updating the information stored in an internal memory as opposed to merely reading the information (read only). Integrated circuits suitable for use in IC chip 44 of RFID tag 40 include those available from Texas Instruments located in Dallas, Tex., Philips Semiconductors located in Eindhoven, Netherlands, and ST Microelectronics located in Geneva, Switzerland, among others.

Modified dipole antenna 42 includes a straight antenna segment 48 coupled to a conductive loop segment 50 disposed on substrate 45. In other words, modified dipole antenna may be viewed as a straight dipole antenna with loop segment 50 added. Straight segment 48 and loop segment 50 may be electrically conductive traces disposed on substrate 45. For example, straight antenna segment 48 may be formed from a first electrically conductive trace and loop segment 50 may be formed of a second electrically conductive trace and coupled to the first conductive trace forming straight antenna segment 48. Straight segment 48 and loop segment 50 may be disposed on substrate 45 using any of a variety of fabrication techniques including chemical vapor deposition, sputtering, etching, photolithography, masking, and the like.

Loop segment 50 illustrated in FIG. 4 is formed in the shape of a rectangle. Loop segment 50 may, however, take on different shapes. For example, loop segment 50 may be formed in the shape of a half-circle, a half-oval, triangle, trapezoid or other symmetric or asymmetric shape. Moreover, although loop segment 50 of FIG. 4 is illustrated as one continuous conductive trace, loop segment 50 may be formed with a discontinuity or "break" in the conductive trace forming the loop. The conductive traces of the loop segment with the discontinuity may still function in a similar manner to a continuous trace loop segment due to capacitive coupling between the discontinuous segments. The same may be true of straight segment 48. In other words, straight segment 48 may include one or more discontinuities in the conductive trace that forms straight segment 48.

In the example illustrated in FIG. 4, loop segment 50 is symmetrically located with respect to the straight segment 48. In other words, straight segment 48 extends an equal distance in the y-directions beyond loop segment 50. In other embodiments, however, loop segment 50 may be asymmetrically located with respect to the straight segment 48. In the example illustrated in FIG. 4, IC chip 44 electrically couples to modified dipole antenna 42 within loop segment 50. As described below, however, IC chip 44 may electrically couple to modified dipole antenna 42 within straight segment 48.

Modified dipole antenna 42 is designed such that when RFID tag 40 is placed on or within an article, RFID tag 40 can easily be concealed (i.e., rendered covert), yet not be easily blocked from the interrogation signal by the hand or other body part of a person. To achieve these features, modified dipole antenna 42 is designed to have a long, narrow aspect represented by length $L_{ANT}$ and width $W_{ANT}$. The width $W_{ANT}$ of modified dipole antenna 42 is designed to allow RFID tag 40 to be covert, while the length $L_{ANT}$ of modified dipole antenna 42 is designed to receive an interrogation signal even when covered by a hand or other body part of a person. In one embodiment, width $W_{ANT}$ may be less than approximately 6 mm (about 0.25 inches), and more preferably approximately 4 mm (about 0.15 inches). In another embodiment, width $W_{ANT}$ of the modified dipole antenna 42 is less than or equal to approximately four times a width of the smaller of the conductive traces that forms modified dipole antenna 42. In the example embodiment illustrated in FIG. 4, the width of the conductive trace forming straight antenna segment 48 and the conductive loop segment 50 may be equal to 1X, and a space between an inside edge of the conductive trace forming loop segment 50 and inside edge of the conductive trace forming straight segment 48 may be equal to approximately 1X, where X is equal to the conductive trace width. Thus, modified dipole antenna 42 may have a width that is approximately three times the width of the conductive traces. In one embodiment, the conductive traces that form modified dipole antenna 42 may have a minimum trace width of a selected manufacturing process, e.g., approximately 1 mm. Such a narrow width of modified dipole antenna 42 allows RFID tag 40 to be concealed, i.e., rendered covert, on or within the article. For example, RFID tag 40 may be placed within a gutter of a book or on an inside portion of a spine of the book to conceal RFID tag 40 from an observer.

As described above, length $L_{ANT}$ of modified dipole antenna 42 is designed to receive an interrogation signal even when covered by a hand or other body part of a person. Length $L_{ANT}$ may be greater than approximately 100 mm (about 4 inches), and more preferably between approximately 125 mm and 140 mm (about between 5 and 5.5 inches), and even more preferably between approximately 130 mm and 135 mm (slightly over 5 inches). At these lengths, when RFID tag 40 is placed within a gutter of a book or on an inside portion of a spine of the book, modified dipole antenna 42 extends beyond a hand of a person holding the book by the spine on or near a geometric centerline 52. Moreover, length $L_{ANT}$ may be further adjusted within the ranges described above such that modified dipole antenna 42 matches dipole response to free space or to surrounding dielectric. For example, length $L_{ANT}$ may be adjusted, for example, to match the dipole response of the paper and binding material in the book to which RFID tag 40 is attached.

A number of aspects of loop segment 50 may also be modified to improve the operation of modified dipole antenna 42. For example, a length $L_{LOOP}$ may be adjusted to affect the sensitivity of modified dipole antenna 42 to various aspects. A longer length $L_{LOOP}$ may increase the sensitivity of modified dipole antenna to signal interference, loss caused by the presence of dielectric material (e.g., pages and other binding materials) and changes in dipole length. Alternatively, or additionally, the shape of loop segment 50 may also be adjusted to affect sensitivity of modified dipole antenna 42. Additionally, forming loop segment 50 or straight segment 48 with discontinuities may also affect sensitivity of modified dipole antenna 42.

As another example, a positioning of loop segment 50 with respect to straight dipole segment 48 may be adjusted to affect sensitivity of modified dipole antenna 42 to changes in various aspects. In the example illustrated in FIG. 4, loop segment 50 is symmetrically located with respect to the straight segment 48. In other words, straight segment 48 extends an equal distance in both the positive and negative y-direction beyond loop segment 50. In other embodiments, however, loop segment 50 may be asymmetrically located with respect to the straight segment 48. Offsetting loop segment 50 so that it is asymmetrically located with respect to straight segment 48 results in modified dipole antenna 42 being less sensitive to the exact value of the dielectric constant of the surrounding medium (i.e., in the case of books, pages and other binding materials). Moreover, modified dipole antenna 42 is less sensitive to adjustments in dipole length.

In order to achieve increased power transfer, the impedance of modified dipole antenna 42 may be conjugately matched to the impedance of IC chip 44. Generally, silicon IC chips have a low resistance and a negative reactance. Thus, to achieve conjugate matching, modified dipole antenna 42 may be designed to have an equivalent resistance and equal and opposite positive reactance. As will be described in further detail below, design of modified dipole antenna 42 to include loop segment 50 may provide modified dipole antenna 42 with improved impedance matching capabilities. Loop segment 50 provides modified dipole antenna 42 with a number of dimensions that may be adjusted to match the impedance of antenna 42 to the impedance of IC chip 44. In particular, the dimensions $W_{ANT}$, and $L_{LOOP}$ may be adjusted to match the impedance of antenna 42 to the impedance IC chip 44 in addition to the dimensions $L_{ANT}$ and the width of the conductive traces (or ratio between the width of the conductive traces of the straight segment and the conductive traces of the loop segment) used to form the various segments. The impedance matching of antenna 42 to that of IC chip 44 may be referred to as "tuning" of antenna 42. In some embodiments, modified dipole antenna 42 may have one or more tuning stubs (not shown), tuning capacitors (not shown) or other separate tuning elements that may be used to tune antenna 42.

RFID tag 40 itself is designed to have a long, narrow aspect that follows the dimensions of modified dipole antenna 42. Thus, the width $W_{TAG}$ of RFID tag 40 is designed to allow the article to be covert, while the length $L_{TAG}$ of RFID tag 40 is designed such that modified dipole antenna 42 may receive an interrogation signal even when covered by a hand or other body party of a person. Width $W_{TAG}$ may be less than approximately 10 mm (about 0.4 inches), and more preferably less than approximately 7 mm (about 0.3 inches). In some cases, RFID tag 40 may be trimmed to the width of modified dipole antenna 42. In other words, the width of RFID tag 40 ($W_{TAG}$) may be approximately equal to the width of antenna 42 ($W_{ANT}$). Length $L_{TAG}$ may be determined based on the length of modified dipole antenna 42. The length $L_{TAG}$ may, for example, be a 2-5 mm longer than the length of modified dipole antenna 42, i.e., $L_{ANT}$. In some embodiments, $L_{TAG}$ may be approximately equal to $L_{ANT}$. In this manner, the width of the RFID tag 40 allows RFID tag 40 to be placed in locations that make RFID tag 40 inconspicuous to the casual observer, e.g., in a gutter (area near the spine where one edge of each page is bound into the binding of a book) or spine of a book, while the length of RFID tag 40 allows modified dipole antenna to receive an interrogation signal even when partially covered by the hand of a person.

The dimensions described above with respect to RFID tag 40 are optimized for operation of RFID tag 40 within the UHF band from approximately 900 MHz to 930 MHz. Minor modifications to these dimensions may be made such that RFID tag 40 may be optimized for operation within other portions of the UHF band, such as around the 868 MHz (European UHF band) or 955 MHz (Japan UHF band). For example, the length of the modified dipole antenna 42 $L_{ANT}$ may be modified in inverse proportion to the frequency of operation. For operation in Europe at the lower center frequency of 868 MHz, dipole antenna length $L_{ANT}$ may be increased by a factor of 915/868. For operation in Japan at the higher center frequency of 955 MHz, the antenna length $L_{ANT}$ may be decreased by a factor of 915/955.

A height or thickness of RFID tag 40 may be selected such that RFID tag 40 does not protrude significantly from the surface of the article to which it is attached. If RFID tag 40 protrudes significantly from the surface of the article, RFID tag 40 may be perceivable and vulnerable to damage or removal. As an example, the height of RFID tag 40 may be in a range of approximately 0.06 mm to 0.59 mm. In one embodiment, RFID tag 40 may have a thickness of approximately 0.275 mm. It should be understood that other heights are possible.

As described above, RFID tag 40 may include one or more adhesive layers or other suitable attachment means to attach the tag to an article (e.g., a book). In one embodiment, for example, RFID tag 40 may include an adhesive layer on either a top surface or bottom surface of RFID tag 40. In fact, in some cases, RFID tag 40 may include an adhesive layer on both the top surface and the bottom surface of tag 40. Adhesive layers, however, are not required. In these cases, RFID tag 40 may be placed on or within the article without the adhesive layer. For example, RFID tag 40 may be placed within the gutter of a book and held in the gutter via the friction between the pages of the gutter and the RFID tag.

Figure 5:
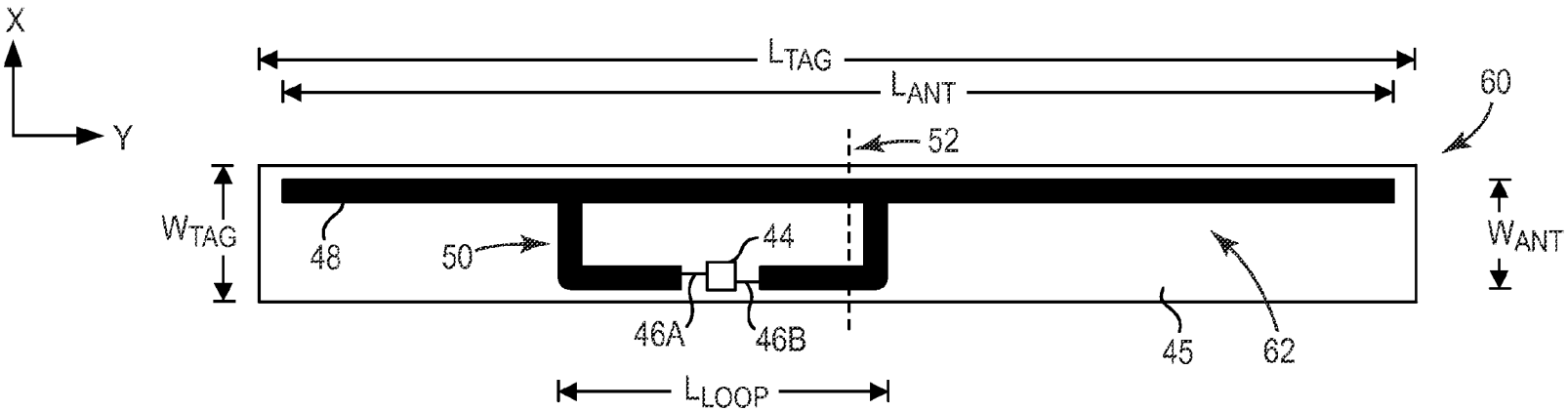
FIG. 5 is a schematic diagram illustrating another exemplary RFID tag with a modified dipole antenna.

FIG. 5 is a schematic diagram illustrating another exemplary RFID tag 60 with a modified dipole antenna 62. Modified dipole antenna 62 conforms substantially to modified dipole antenna 42 of FIG. 4, except loop segment 50 of modified dipole antenna 62 is asymmetrically located with respect to geometric centerline 52 of the modified dipole antenna 62 instead of being symmetrically located with respect to geometric centerline 52. In particular, straight dipole segment 48 of modified dipole antenna 62 does not extend equal distances in both y-directions beyond loop segment 50. Instead, straight dipole segment 48 of modified dipole antenna 62 extends further along the y-axis in one direction than the other. As described above, offsetting loop segment 50 so that it is asymmetrically located with respect to straight segment 48 results in modified dipole antenna 62 being less sensitive to various parameters than modified dipole antenna 42. For example, modified dipole antenna 62 may be less sensitive to variations in the dielectric constant of the surrounding medium (i.e., in the case of books, pages and other binding materials). As another example, modified dipole antenna 62 may be less sensitive to various dipole lengths.

Figure 6:
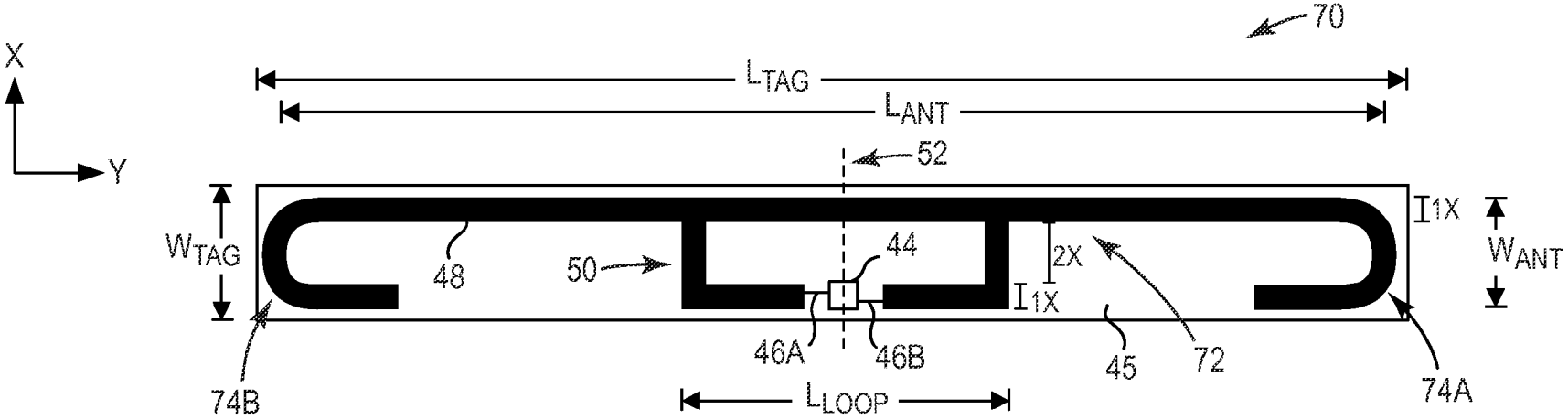
FIG. 6 is a schematic diagram illustrating another exemplary RFID tag with a modified dipole antenna.

FIG. 6 is a schematic diagram illustrating another exemplary RFID tag 70 with a modified dipole antenna 72. RFID tag 70 conforms substantially to RFID tag 40 of FIG. 4, except modified dipole antenna 72 is a modified folded dipole antenna instead of a modified straight dipole antenna as in FIG. 4. In other words, modified dipole antenna 72 includes fold segments 74A and 74B (collectively, "fold segments 74") located at respective ends of straight segment 48. Fold segments 74A and 74B each include a curve portion that curves in the direction of loop segment 50 and a straight portion that runs parallel with straight segment 48 toward loop segment 50. Although fold segments 74 are illustrated in FIG. 6 as half-circle or half-oval folded segments, fold segments may take on different shapes. For example, fold segments 74 may be formed in the shape of a half-rectangle, a portion of a triangle, or the like. In any case, straight portions of fold segments 74 run substantially parallel to the straight segment 48. Moreover, the size of the folds may also be increased or decreased.

The modified folded dipole antenna 72 may allow for extended readability, and thus better tag performance. This is particularly true when RFID tag 70 is located on or in an article that includes one or more other tags. In other words, modified folded dipole antenna 72 provides increased performance when placed on a multi-tagged item. Fold segments 74 also increase the effective length of tag 70, allowing for more flexibility to tune the tag parameters. Additionally, fold segments 74 may make RFID tag 70 more responsive to off-axis signals. Moreover, fold segments may give RFID tag 70 an input impedance that is more consistent when placed in books (or other articles) with different dielectric constants.

In the example illustrated in FIG. 6, the width of the conductive trace forming straight antenna segment 48 and the conductive loop segment 50 may be equal to 1X, and a space between an inside edge of the conductive trace forming loop segment 50 that is parallel to straight segment 48 and inside edge of the conductive trace forming straight segment 48 may be equal to approximately 2X, where X is equal to the conductive trace width. Thus, modified dipole antenna 72 of FIG. 6 may have a width that is approximately four times the width of the conductive traces. In one embodiment, the conductive traces that form modified dipole antenna 72 may have a minimum trace width of a selected manufacturing process, e.g., approximately 1 mm. Thus, modified dipole antenna 72 has substantially similar dimensions as described above with respect to FIG. 4.

Figure 7A:
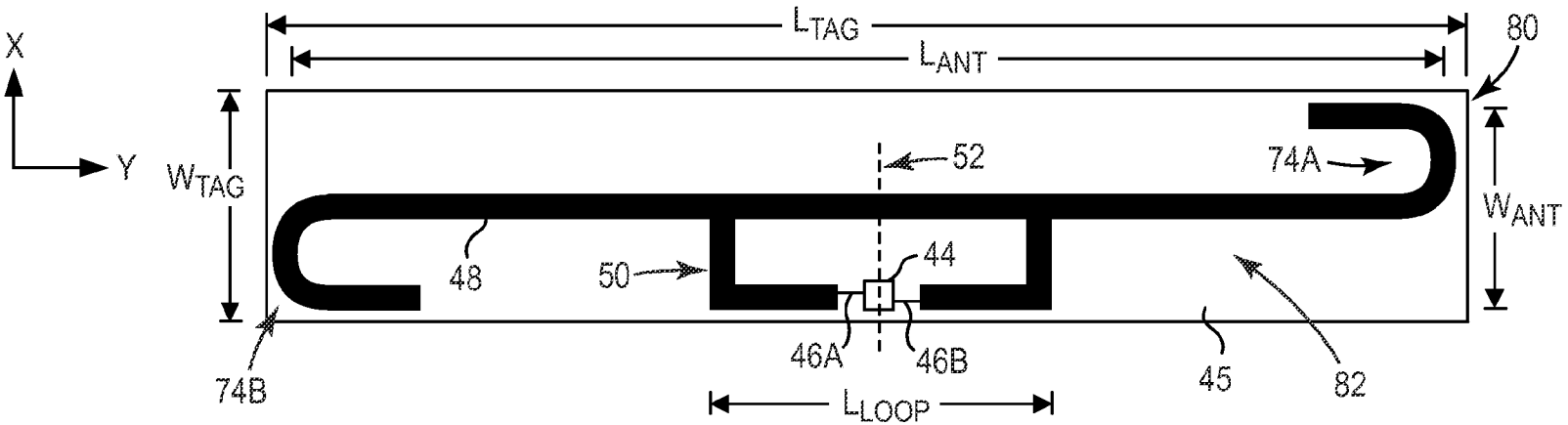
FIG. 7A is a schematic diagram illustrating another exemplary RFID tag with a modified dipole antenna that includes an example folded dipole segment.

FIG. 7A is a schematic diagram illustrating another exemplary RFID tag 80 with a modified dipole antenna 82. Modified dipole antenna 82 conforms substantially to modified dipole antenna 72 of FIG. 6, except at least one of the folds of modified dipole antenna 82 folds in a direction opposite the location of loop segment 50. In the embodiment illustrated in the example of FIG. 7A, only one of the folds of modified dipole antenna 82 folds in the direction opposite the location of loop segment 50. However, in other embodiments, both of the folds may fold in the direction opposite the location of loop segment 50. In either case, however, the width of the antenna may be on the slightly larger side of the dimensions described above. For example, the width of modified dipole antenna may be closer to the 8-10 mm range.

Figure 7B:
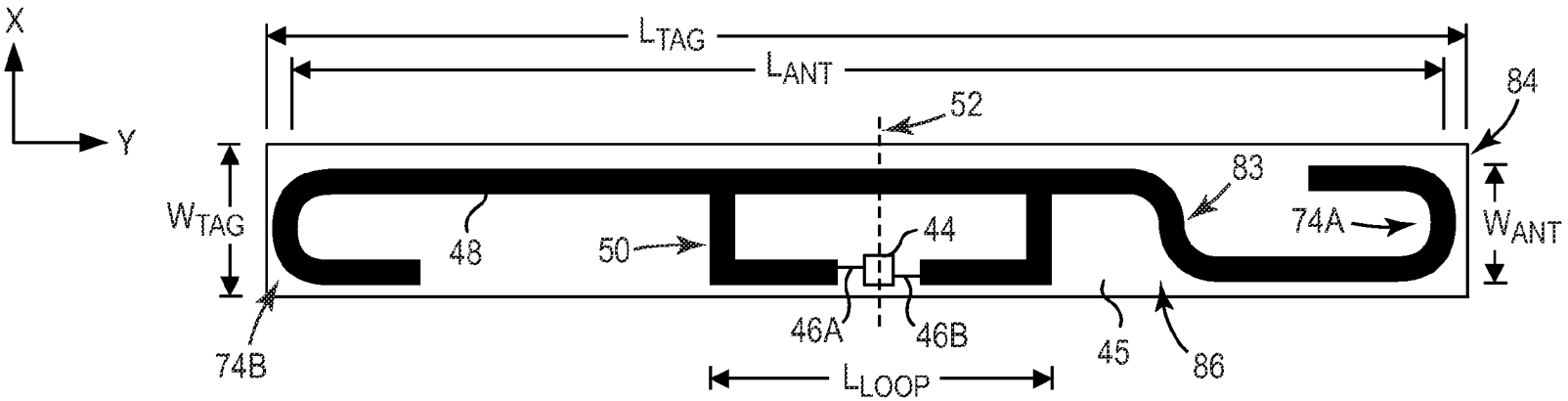
FIG. 7B is a schematic diagram illustrating another exemplary RFID tag with a modified dipole antenna that includes another example folded dipole segment.

FIG. 7B is a schematic diagram illustrating another exemplary RFID tag 84 with a modified dipole antenna 86. Like antenna 82 of FIG. 7A, antenna 84 of FIG. 7B includes at least one fold segment (i.e., 74A of FIG. 7B) that folds in a direction opposite the location of loop segment 50. However, antenna 86 of FIG. 7B is formed such that the width of antenna 86 is substantially similar to that of the antennas illustrated in FIGS. 4-6. In other words, fold segment 74A does not cause the width of antenna 86 to be larger. In particular, a meander segment 83 slopes from straight segment 48 to a beginning of folded segment 74A, which is located at approximately the same distance in the x-direction as the segment of the conductive trace of loop segment 50 that is parallel to straight segment 48. Other similar modifications of the straight dipole segment may be made to reduce the width of the antenna.

Figure 8:
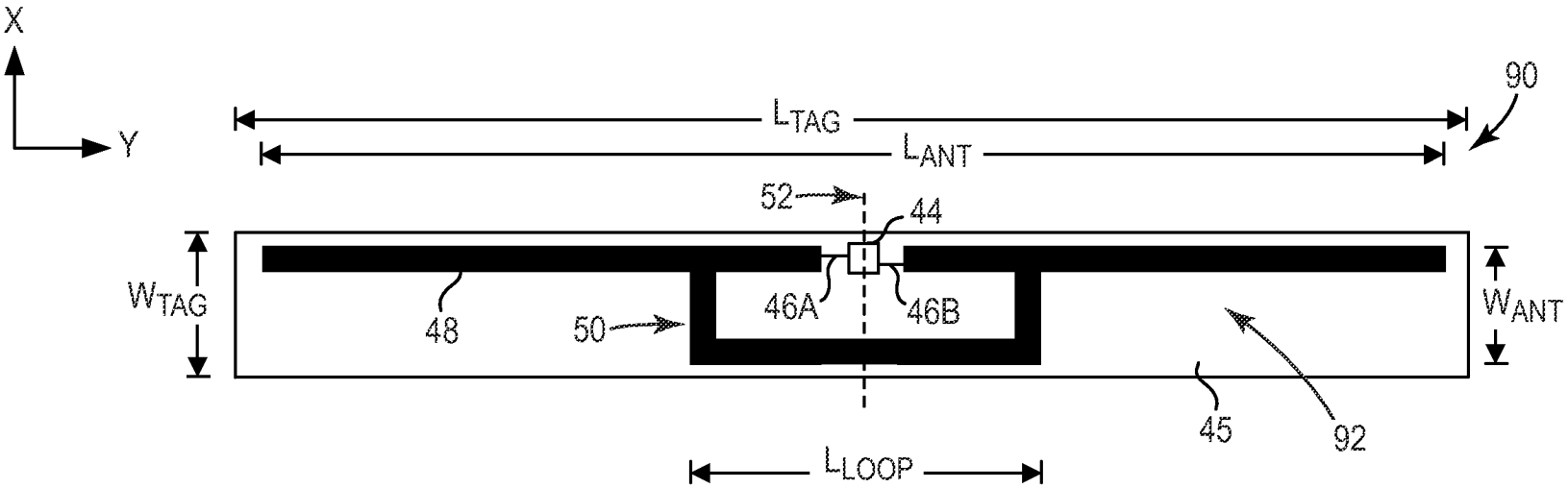
FIG. 8 is a schematic diagram illustrating another exemplary RFID tag with a modified dipole antenna.

FIG. 8 is a schematic diagram illustrating another exemplary RFID tag 90 with a modified dipole antenna 92. Modified dipole antenna 92 conforms substantially to modified dipole antenna 42 of FIG. 4, except IC chip 44 is electrically connected to modified dipole antenna 42 within straight dipole segment 48 of modified dipole antenna 92 instead of within loop segment 50.

FIGS. 9-12 are graphs illustrating exemplary RFID signal strengths for RFID tags designed in accordance with the techniques of this disclosure. As illustrated in FIGS. 9-12, the signal strength of the modified dipole antennas is strong across a broad "maximum." The broad maximum signal strength of the modified dipole antenna provides the advantage of good performance over a wide range of variability inherent in articles of nearly any protected area. In the context of a library, for example, the collection of books includes books with significantly different dielectric constants due to various book properties such as size (e.g., thick or thin), paper types (e.g., shiny clay-filled papers or low-density papers), different types of inks, different quantities of inks (e.g., especially on book covers/jackets), different adhesives used to attach pages to spine, or other interferences, such as multiple tag environments that have more than one tag on a book. The broad maximum signal strength of the modified dipole antenna allows a single RFID tag design to operate with satisfactory performance in any type of book.

Figure 9:
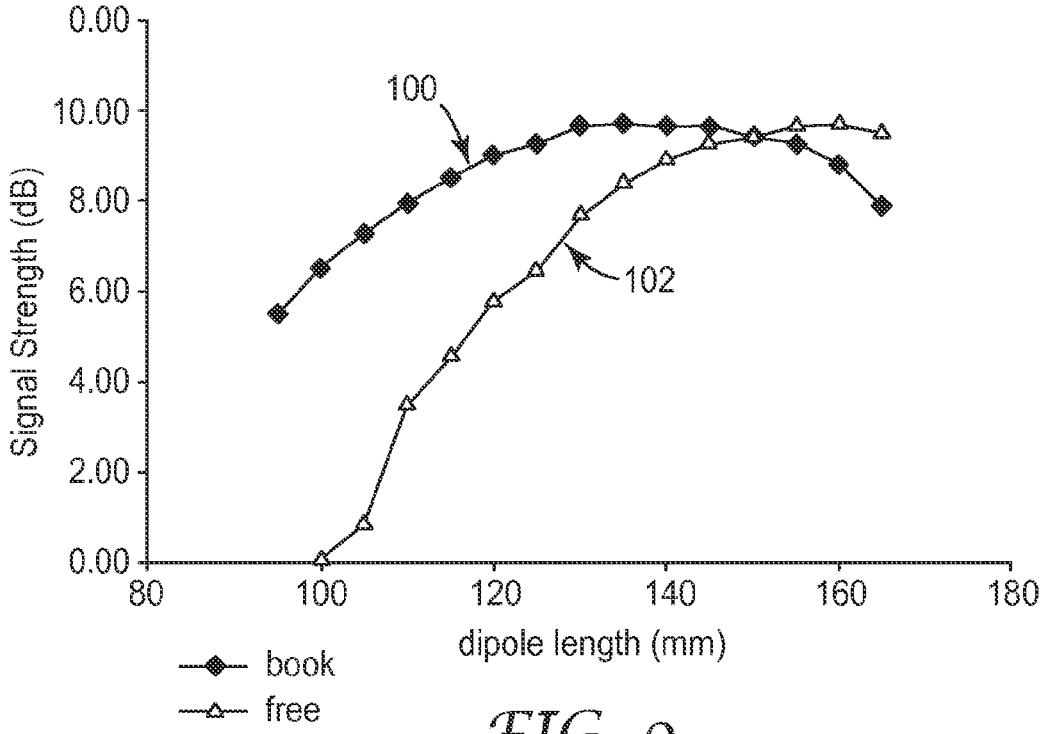
FIG. 9 is a graph illustrating exemplary RFID signal strength for an RFID tag designed in accordance with the techniques of this disclosure.

FIG. 9 is a graph illustrating exemplary RFID signal strength for an RFID tag designed in accordance with the techniques of this disclosure. The exemplary RFID response results illustrated in FIG. 9 is for an RFID tag that includes a modified dipole antenna of the type illustrated in FIG. 4. In this test, the length, e.g., $L_{LOOP}$, of the loop segment 50 of the RFID antenna was 25 mm. Loop segment 50 was initially symmetrically located with respect to straight dipole segment 48. The straight dipole segment 48 was initially 165 mm in length. Segments of 5 mm were incrementally cut off the modified dipole antenna and a test measurement was obtained. For example, the first 5 mm increment was cut off a first end of the straight dipole segment such that the straight dipole segment was slightly asymmetric. A test measurement was taken. Then a second 5 mm segment was removed from the opposite end of straight dipole segment 48, thus making the tag symmetrical again, and another measurement was taken. The 5 mm segments were incrementally removed from opposite ends until the total length of straight dipole segment 48 was 100 mm. In this manner, the RFID response was measured for straight dipole segment lengths of 100 mm to 165 mm. The RFID tag was tested for RFID response in free space (represented by line 102) and while inserted into the gutter of a book (represented by line 100) to demonstrate the dependence of RFID response on dipole length.

As illustrated in the graphs of FIG. 9, the modified dipole antenna of the RFID tag shows a peak response in free space for a dipole length of 160 mm and a peak response when placed within the book at a dipole length of above 140 mm. The length of dipole antenna may be selected such that the modified dipole can compensate for the signal interference and loss caused by the presence of dielectric materials (paper).

Figure 10:
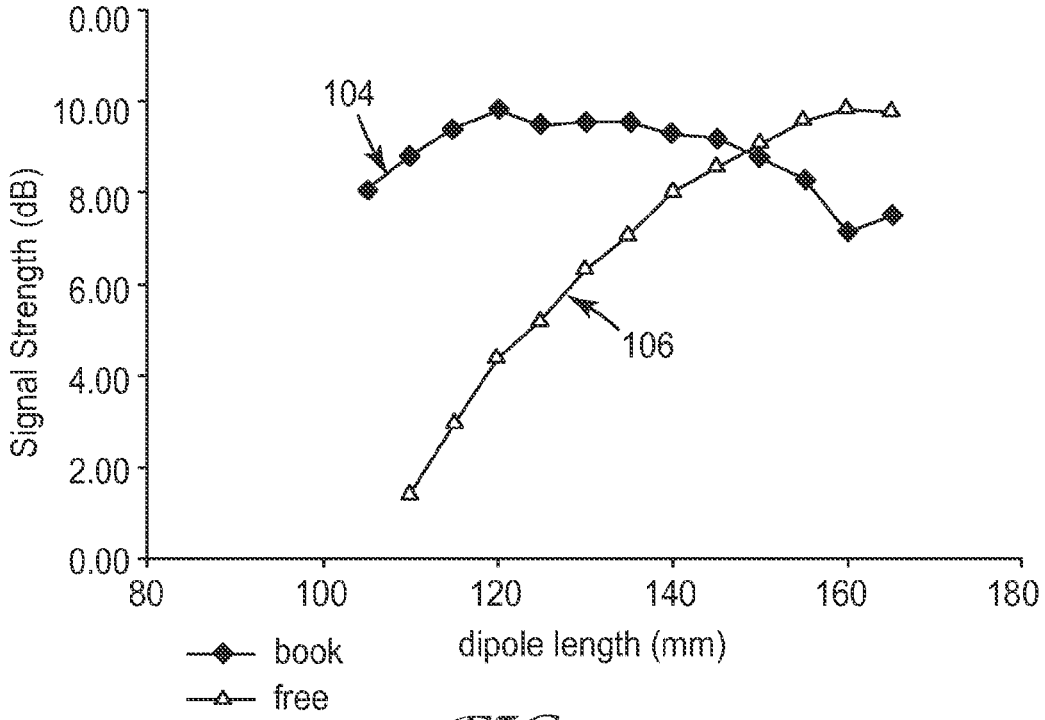
FIG. 10 is another graph illustrating another exemplary RFID signal strength for an RFID tag designed in accordance with the techniques of this disclosure.

FIG. 10 is another graph illustrating RFID signal strength for another exemplary RFID tag designed in accordance with the techniques of this disclosure. In this test the RFID tag used to generate the results illustrated in FIG. 10 was of the same design as the results in FIG. 9. As described above, the initial tag configuration included a 165 mm straight dipole segment and a 25 mm loop segment initially symmetrically located with respect to straight dipole segment 48. Thus, the initial reading of the 165 mm tag is with no offset. Unlike described above with respect to FIG. 9, however, the 5 mm segments were removed from only a single side of the straight dipole segment 48, thus increasing the amount of offset of loop segment 50 with respect to the centerline of straight dipole segment 48. Test measurements were again taken at each 5 mm increment in length from 165 mm to 100 mm.

The response of the modified dipole antenna in the book shows a broad maximum from 140 mm to 120 mm. The strength of the response of the asymmetric modified dipole across a broad range of dipole antenna lengths indicate that the modified dipole will be relatively insensitive to the exact value of the dielectric constant of the surrounding medium when the loop is asymmetrically placed. Moreover, the antenna is less sensitive to adjustments in length of straight dipole segment 48.

Figure 11:
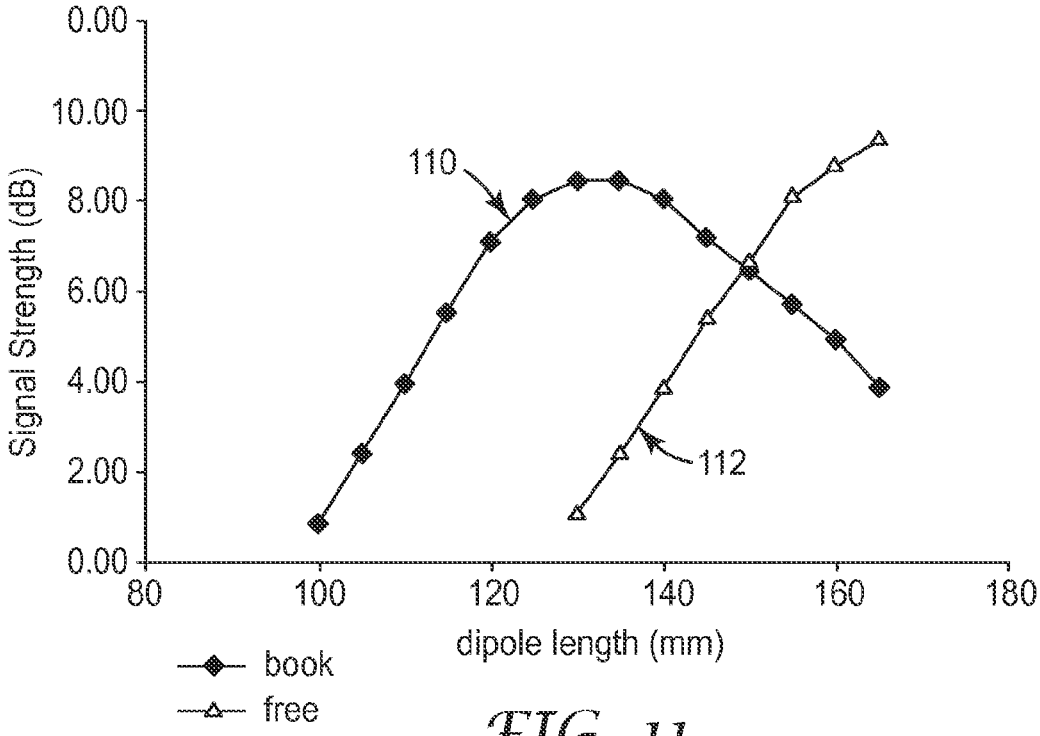
FIG. 11 is a graph illustrating exemplary RFID signal strength for an RFID tag designed in accordance with the techniques of this disclosure.

FIG. 11 is a graph illustrating exemplary RFID response signal strength for yet another exemplary RFID tag designed in accordance with the techniques of this disclosure. In this test the RFID tag used to generate the results illustrated in FIG. 11 was of the same design as the results in FIG. 9, but the length, e.g., $L_{LOOP}$, of the symmetrically located loop segment 50 was 37 mm instead of 25 mm. The RFID tag, however, was incrementally shortened by 5 mm in the manner described above with respect to FIG. 9. The response of the symmetric modified dipole antennas with 37 mm loop illustrated the length of loop segment 50 of the modified dipole antenna affects the signal interference and loss caused by the presence of dielectric materials (paper).

Figure 12:
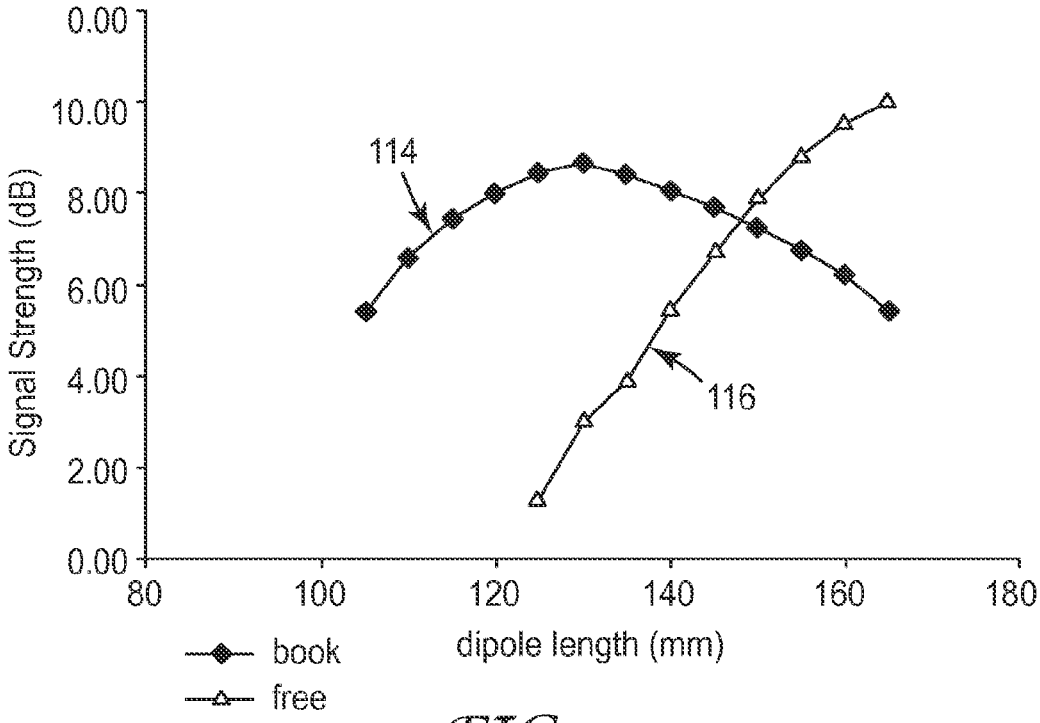
FIG. 12 is another graph illustrating another exemplary RFID signal strength for an RFID tag designed in accordance with the techniques of this disclosure.

FIG. 12 is another graph illustrating another exemplary RFID signal strength for another exemplary RFID tag designed in accordance with the techniques of this disclosure. The RFID tag used to generate the results illustrated in FIG. 12 was of the same design as the results in FIG. 11, but the loop segment 50 of the modified dipole antenna was incrementally shortened in the manner described above with respect to FIG. 10 to test the affect of the increase in asymmetrical offset with respect to the centerline of straight dipole segment 48. The length of the loop segment remained at 37 mm. The response of the modified dipole antenna in the book (i.e., line 114) shows a broad maximum from a dipole length 140 mm to 120 mm. The strength of the response of the asymmetric modified dipole across a broad range of dipole antenna lengths indicate that the modified dipole will be relatively insensitive to the exact value of the dielectric constant of the surrounding medium when the loop is asymmetrically placed. Moreover, the antenna is less sensitive to adjustments in length of straight dipole segment 48.

Figure 13:
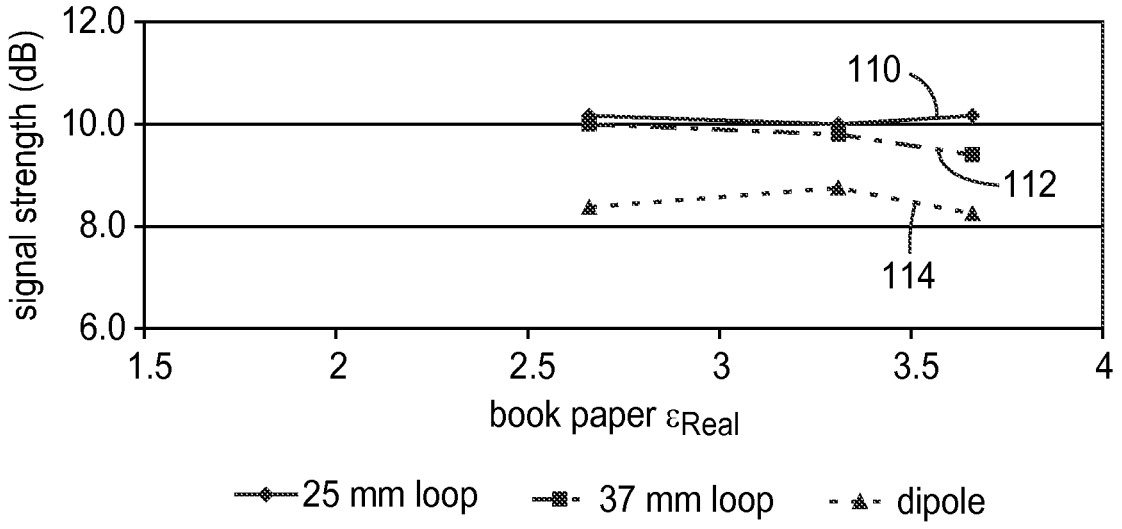
FIG. 13 is a graph illustrating a comparison of signal strengths experimentally measured for an RFID tag with a conventional dipole antenna as well as two RFID tags having modified dipole antennas designed in accordance with the techniques of this disclosure.
Figure 14A:
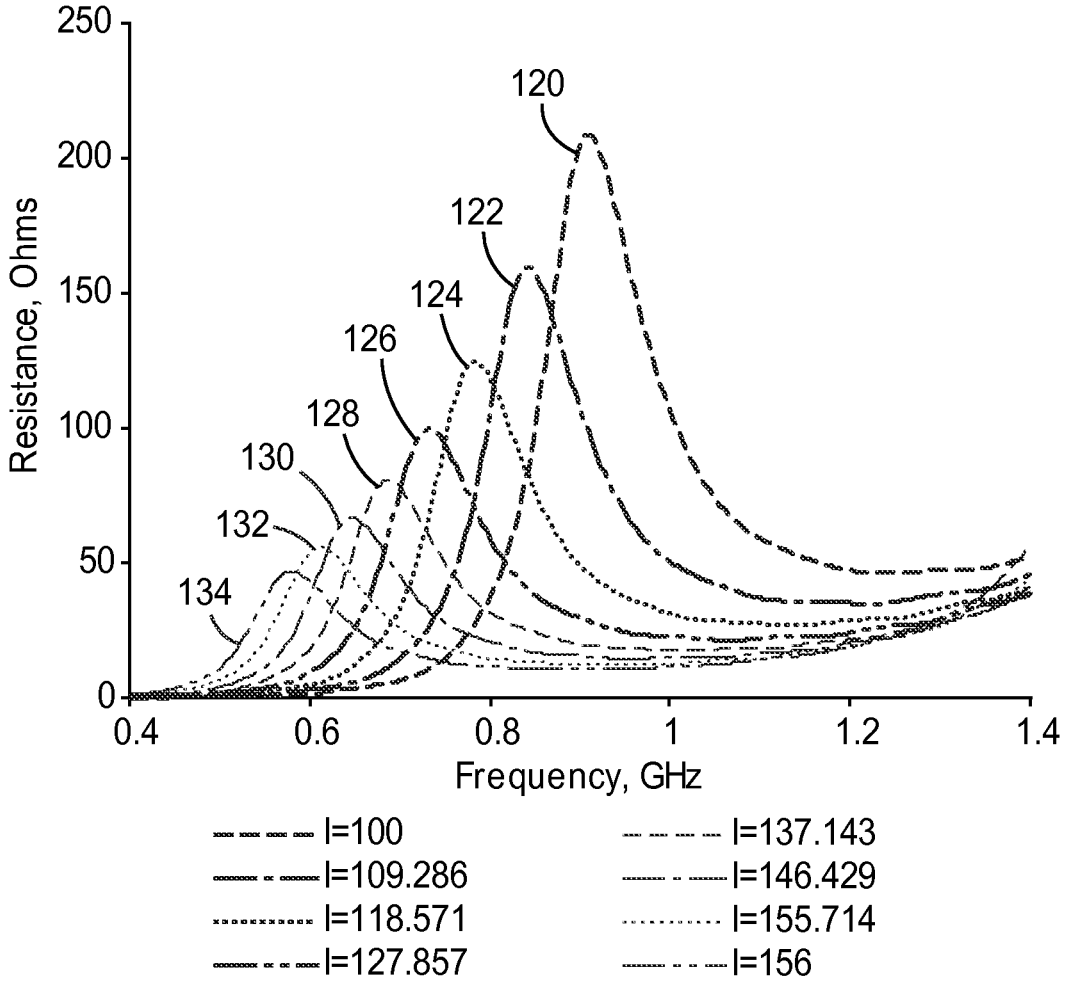
FIGS. 14A and 14B illustrate exemplary impedance changes as a function of varying antenna lengths.
Figure 14B:
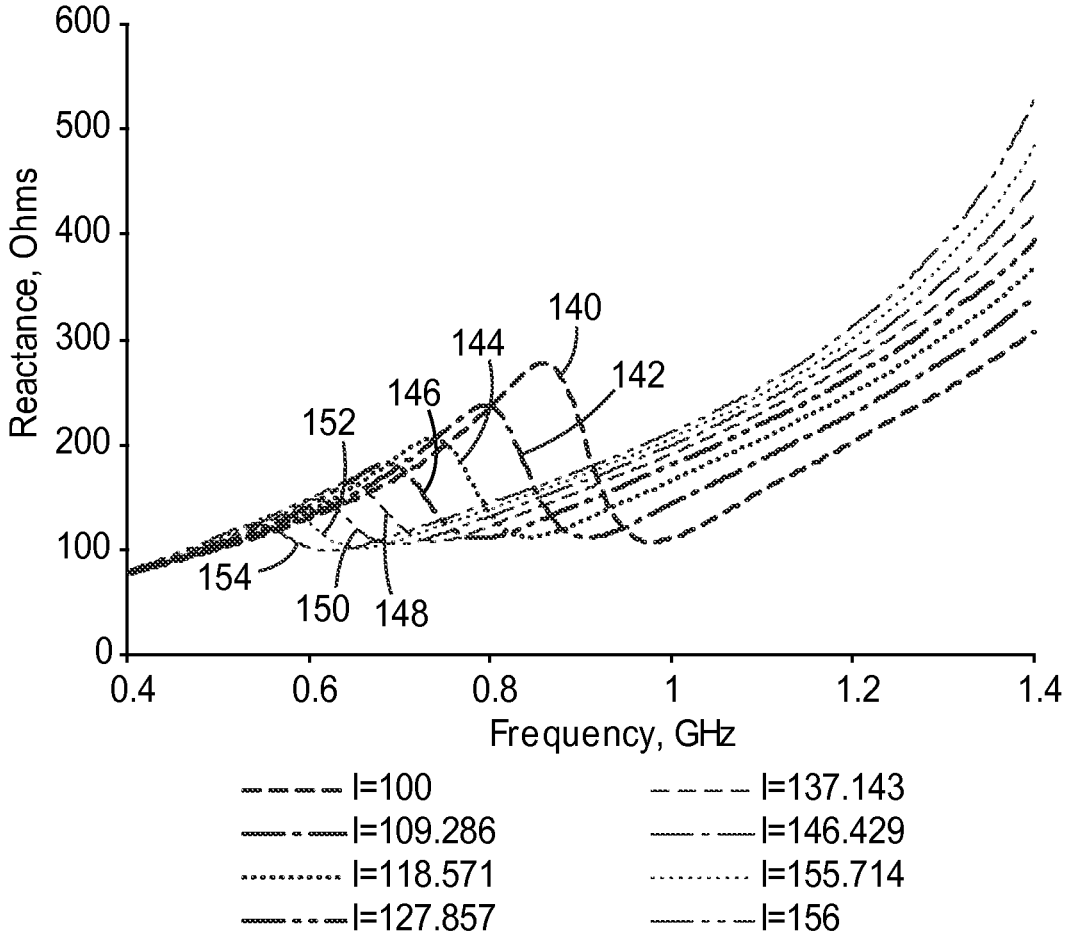

FIG. 13 is a graph illustrating a comparison of signal strengths experimentally measured for an RFID tag with a conventional dipole as well as two RFID tags having modified dipole antennas designed in accordance with the techniques of this disclosure. The two types of RFID tag designs are similar in form to the RFID tag illustrated in FIG. 8, differing in the length ($L_{LOOP}$) of the loop segment 50 of the modified dipole antenna. The first design of this example has a loop segment 50 with length $L_{LOOP}$ of 25 mm. The second design of this example has a loop segment 50 with length $L_{LOOP}$ of 37 mm. Both designs have the same length ($L_{ANT}$) of dipole segment 48, with $L_{ANT}$ equal to 130 mm. In other respects the two types of RFID tags have similar dimensions to the previous examples, including line width and trace thickness of antenna and loop segments, substrate type and thickness and IC chip (attached in the center of the straight dipole segment 48. The conventional dipole antenna tested in this example is a simple straight dipole antenna comprising two equal conductor segments with total length $L_{ANT}$ of 130 mm, including the IC 44 attached at the center. In all other aspects, the dipole antenna is equivalent to the modified dipole antennas of this disclosure, without a loop segment 50.

The signals strengths of each of the RFID tags were measured while each of the tags was placed within three different books. The three books in this example represent a range of dielectric properties one would expect to find in commonly available library books. Table 1 below summarizes the real part of the dielectric constant ($\in_R$) and the loss tangent (tan δ) for each of the books cover and pages. Table 1 includes a column indicating the total page thickness at the midpoint of each book. The total page thickness at the midpoint is measured to include the pages from the front of the book to the midpoint page where each RFID tag was inserted to test the effect of the book on the tag.

TABLE 1

Book dielectric properties.

| | tag inserted at midpoint page number | cover $\epsilon_R$ | cover tan δ | cover thickness mm | page $\epsilon_R$ | page tan δ | total page thickness at midpoint mm |
|---|---|---|---|---|---|---|---|
| Book A | pg. 130 | 2.65 | 0.151 | 2.45 | 2.66 | 0.135 | 9.347 |
| Book B | pg. 140 | 2.86 | 0.148 | 2.32 | 3.31 | 0.169 | 7.264 |
| Book C | pg. 60 | 2.55 | 0.0989 | 2.59 | 3.66 | 0.1131 | 4.470 |

The response signal of each of the RFID tags was determined by placing each of the RFID tags, in turn, into each book. Only one tag was installed in the book under test, and it was removed after the test. The response signal of the RFID tag in the book was determined for each of the tags placed in each of the books. The resulting curves are plotted in FIG. 13 as signal strength as a function of dielectric constants for each of three RFID antenna designs. The lines connecting the data points are added as an approximation of the response of the tags.

The RFID tags designed in accordance with this disclosure show relatively high values of response signal as compared to the conventional dipole antenna. In FIG. 13, the curve 110 represents the signal strength of the RFID tag having the modified antenna with the 25 mm loop segment, curve 112 represents the signal strength of the RFID tag having the modified dipole antenna with the 37 mm loop and curve 114 represents the signal strength of the RFID tag having the conventional dipole antenna.

As illustrated in the graph of FIG. 13, curve 110 of the signal strength of the RFID tag with 25 mm loop is substantially constant across the several values of dielectric constant for the three books of the example. The relatively constant signal strength of the RFID tag with 25 mm loop may improve overall system response and simplify system design because the signal strength may be approximately the same for any book with dielectric constant within the range represented by the books of this example.

The curve 112 of the signal strength of the RFID tag with the 37 mm loop segment shows a decrease compared to the response signal of the 25 mm loop at the highest value of dielectric constant. However, the signal strength is relatively constant over the lower values of dielectric constant compared to the conventional dipole segment.

The curve 114 of the signal strength of the RFID tag with the conventional dipole antenna (i.e., no loop segment) shows a signal strength that is lower than the signal strengths of either of the RFID tags designed in accordance with this disclosure. In the example illustrated in FIG. 13, the signal strength is approximately 1.5-2 dB weaker than the modified dipole antennas designed in accordance with this disclosure. The signal strength of the conventional dipole antenna is particularly lower at both the low dielectric constant and high dielectric constant values. The overall lower signal strength 114 of the conventional dipole antenna tag may make it more difficult for the RFID system to communicate with the tag in a book, especially a book with a higher or lower dielectric constant.

FIGS. 14-17 are graphs based on modeling data for RFID tags in accordance with the principles described herein. The graphs illustrate exemplary impedance changes as a function of adjustments to a modified dipole antenna that includes a loop segment in accordance with the techniques of this disclosure. FIGS. 14A and 14B illustrate exemplary impedance changes as a function of varying antenna lengths, e.g., various values of $L_{ANT}$. In particular, FIG. 14A shows changes in the real part of the impedance as a function of varying antenna lengths from 100 mm to 165 mm. Curves 122, 124, 126, 128, 130, 132 and 134 correspond to the real part of the impedance (in ohms) with antenna lengths varying from 100, 109.286, 118.571, 127.857, 137.143, 146.429, 155.714 and 165 (in mm), respectively. Likewise, FIG. 14B shows changes in the imaginary part of the impedance as a function of the varying antenna lengths, with curves 140, 142, 144, 146, 148, 150, 152 and 154 corresponding to the imaginary part of the impedance with antenna lengths varying from 100, 109.286, 118.571, 127.857, 137.143, 146.429, 155.714 and 165 (in mm), respectively.

Figure 15A:
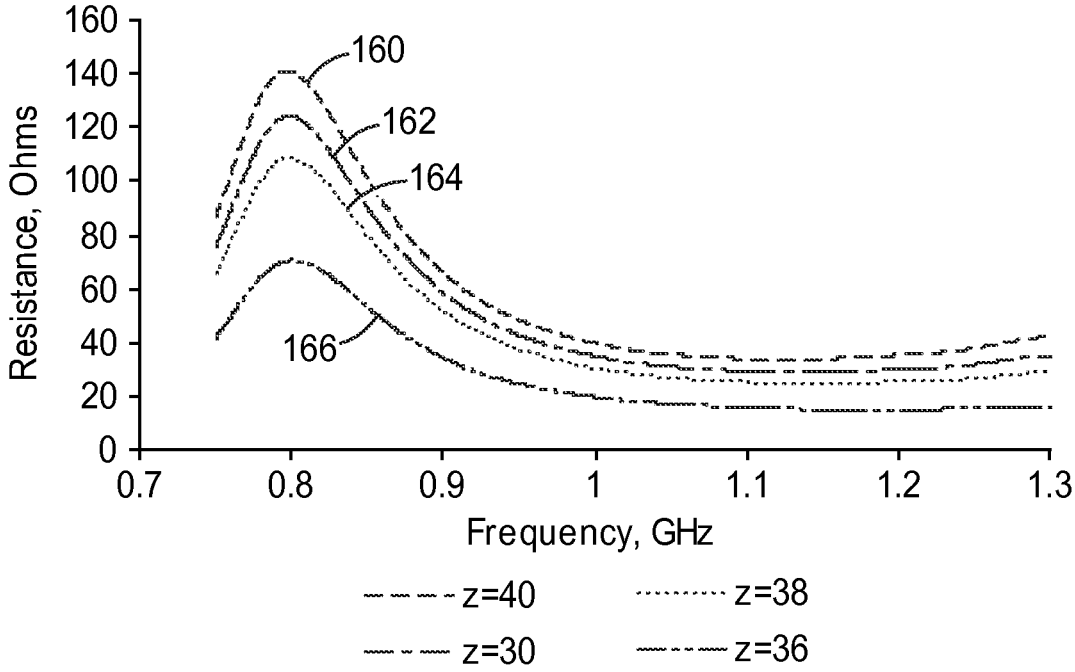
FIGS. 15A and 15B are graphs of exemplary impedance changes as a function of varying length of a loop segment.
Figure 15B:
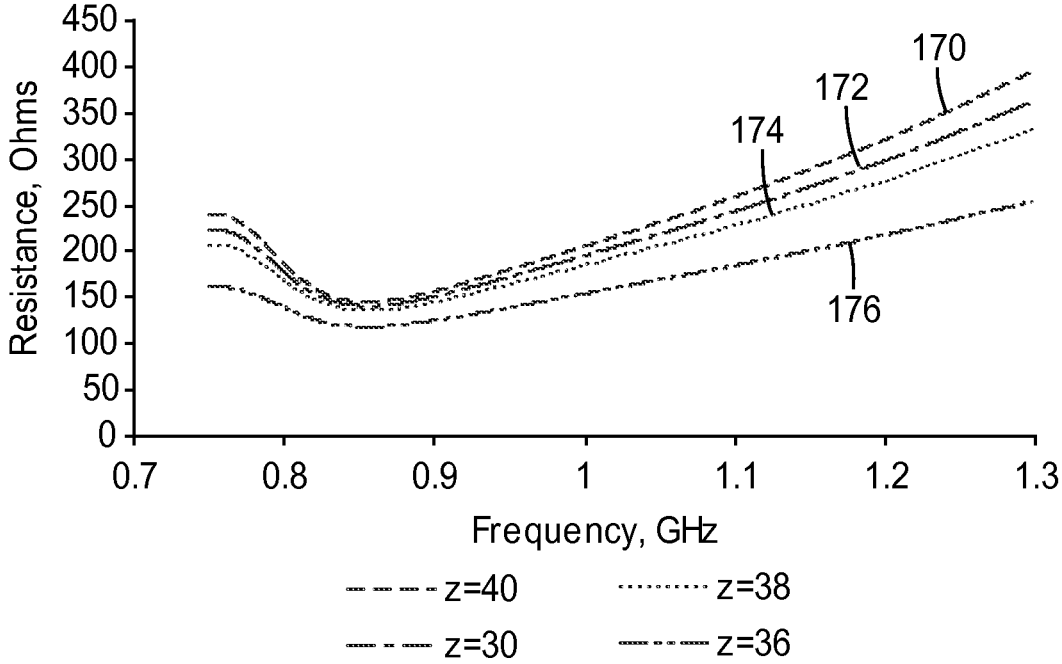

FIGS. 15A and 15B are graphs of exemplary impedance changes as a function of varying length of a loop segment, i.e., $L_{LOOP}$. In particular, FIG. 15A shows changes in the real part of the impedance as a function of varying loop lengths from 30 mm to 40 mm. Curves 160, 162, 164 and 166 correspond to the real part of the impedance (in ohms) with loop lengths varying from 40, 38, 36 and 30 (in mm), respectively. Likewise, FIG. 15B shows changes in the imaginary part of the impedance as a function of the varying loop lengths, with curves 170, 172, 174 and 176 corresponding to the imaginary part of the impedance with loop lengths varying from 40, 38, 36 and 30 (in mm), respectively. As can be seen from the graphs illustrated in FIG. 15, longer loop lengths ($L_{LOOP}$) result in increased real and imaginary components of the impedance.

Figure 16A:
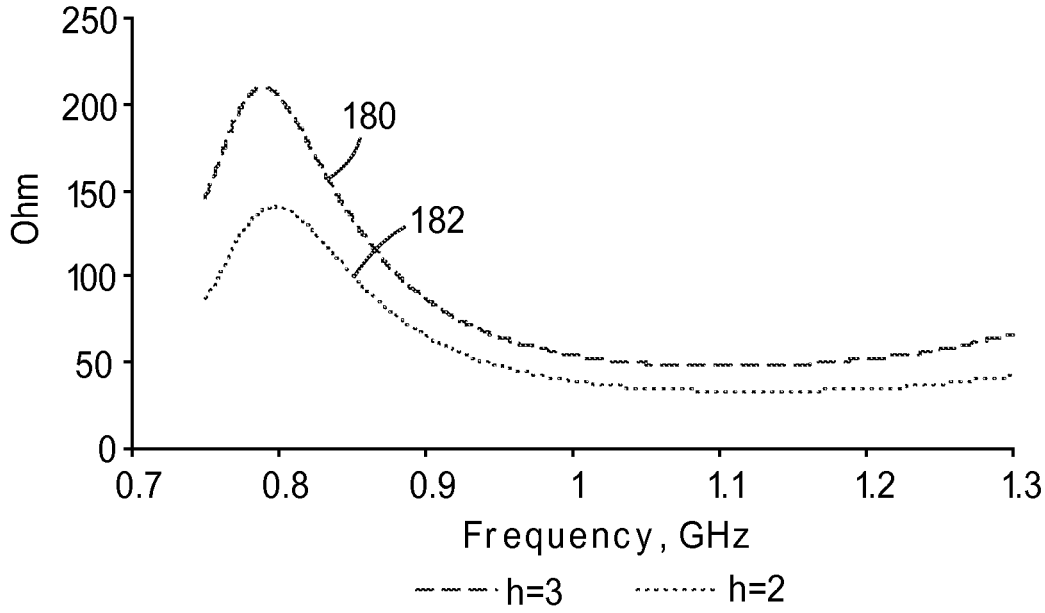
FIGS. 16A and 16B are graphs of exemplary impedance changes as a function of loop width.
Figure 16B:
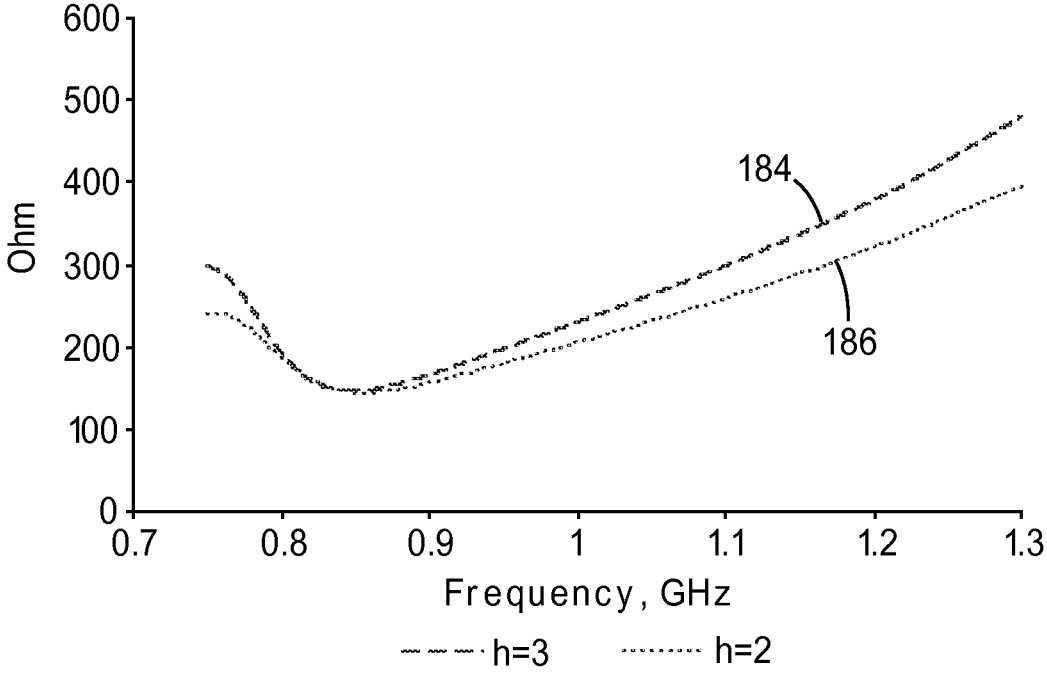

FIGS. 16A and 16B are graphs of exemplary impedance changes as a function of varying a space between an inside edge of the conductive trace forming loop segment 50 and inside edge of the conductive trace forming straight segment 48, referred to herein as loop width. In particular, FIG. 16A shows changes in the real part of the impedance as a function of loop widths of 2 mm and 3 mm. Curves 180 and 182 correspond to the real part of the impedance (in ohms) with loop widths of 3 mm and 2 mm, respectively. Likewise, FIG. 16B shows changes in the imaginary part of the impedance as a function of the varying loop widths, with curves 184 and 186 corresponding to the imaginary part of the impedance with loop widths of 3 mm and 2 mm, respectively. As can be seen from the graphs illustrated in FIG. 16, larger loop widths i.e., spacing between an inside edge of the conductive trace forming loop segment 50 and inside edge of the conductive trace forming straight segment 48, result in increased real and imaginary components of the impedance.

Figure 17A:
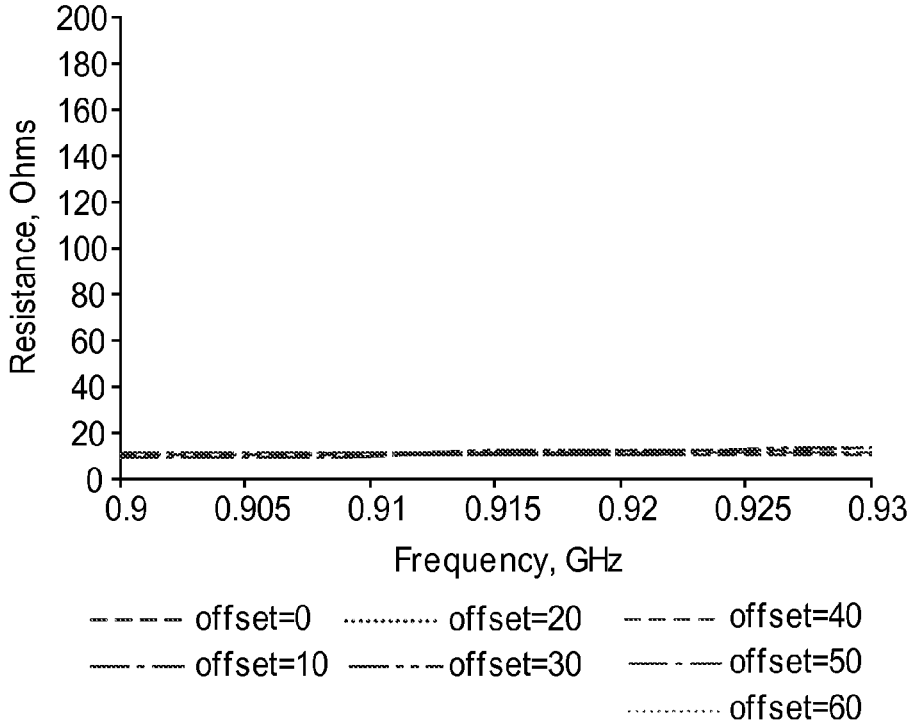
FIGS. 17A and 17B are graphs of exemplary impedance changes as a function of an offset of the loop from a geometric centerline of the straight segment of the modified dipole antenna.
Figure 17B:
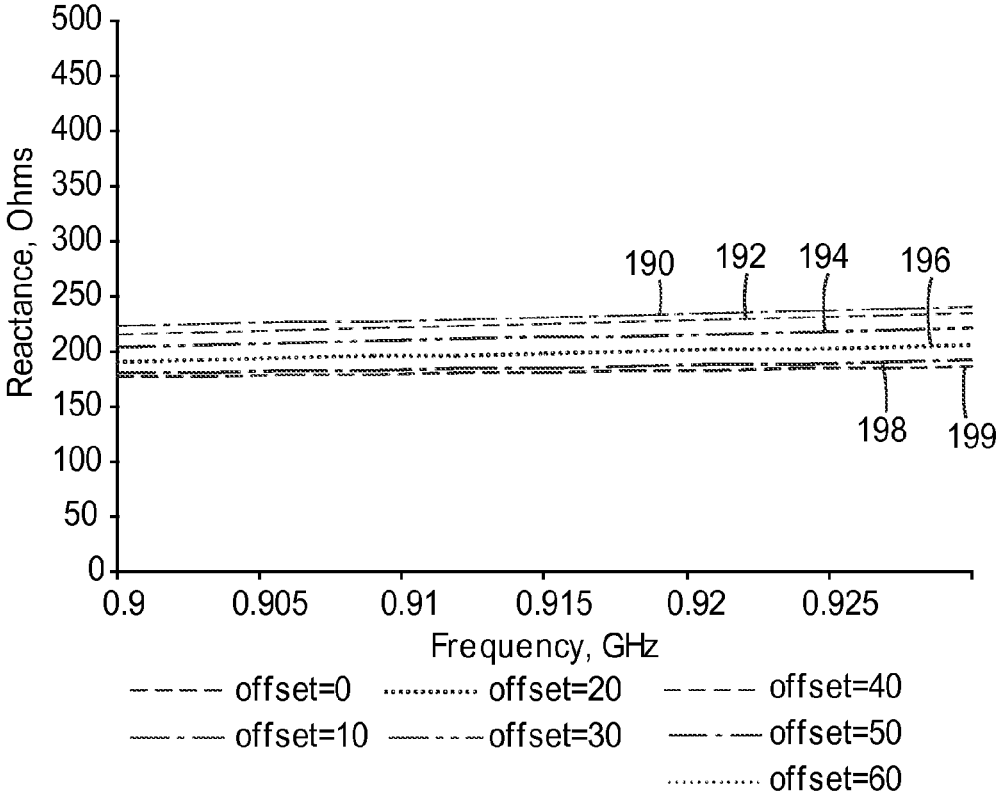

FIGS. 17A and 17B are graphs of exemplary impedance changes as a function of an offset of the loop from a geometric centerline of the straight segment of the modified dipole antenna, referred to herein as "offset." In particular, the overall tag length and loop dimensions are kept constant. The loop is offset 0, 10, 20, 30, 40, 50, and 60 mm from the center of the tag. In the broad frequency range, there were significant changes (not illustrated). However in the UHF RFID band as plotted in FIG. 17, the response is fairly flat and does not deviate significantly with the various offsets. The real component of the impedance experiences relatively no change, while the imaginary component slightly increases as the offset increases.

Figure 18:
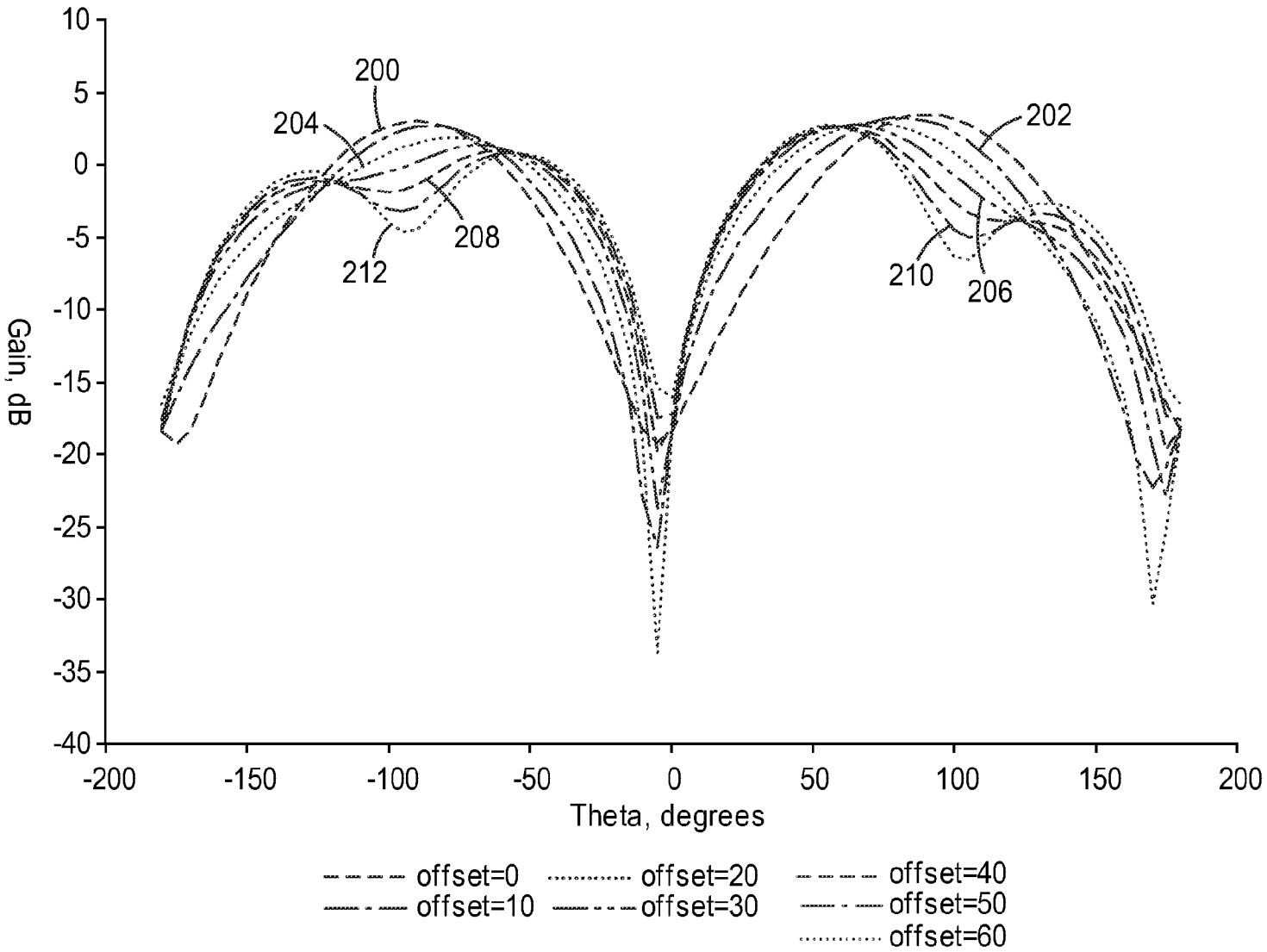
FIG. 18 illustrates the radiation pattern as a function of an offset of the loop.

Offsetting the loop may cause changes in the radiation pattern of the modified dipole antenna. FIG. 18 illustrates the radiation pattern as the offset moves from 0 offset (i.e., symmetrically placed) toward 60 mm offset. Curves 200, 202, 204, 206, 208, 210 and 212 represent the radiation pattern of the antenna for offsets of 0, 10, 20, 30, 40, 50 and 60 (in mm), respectively. As illustrated in FIG. 18, there is a significant null that develops at the location broadside to the antenna.

Figure 19A:
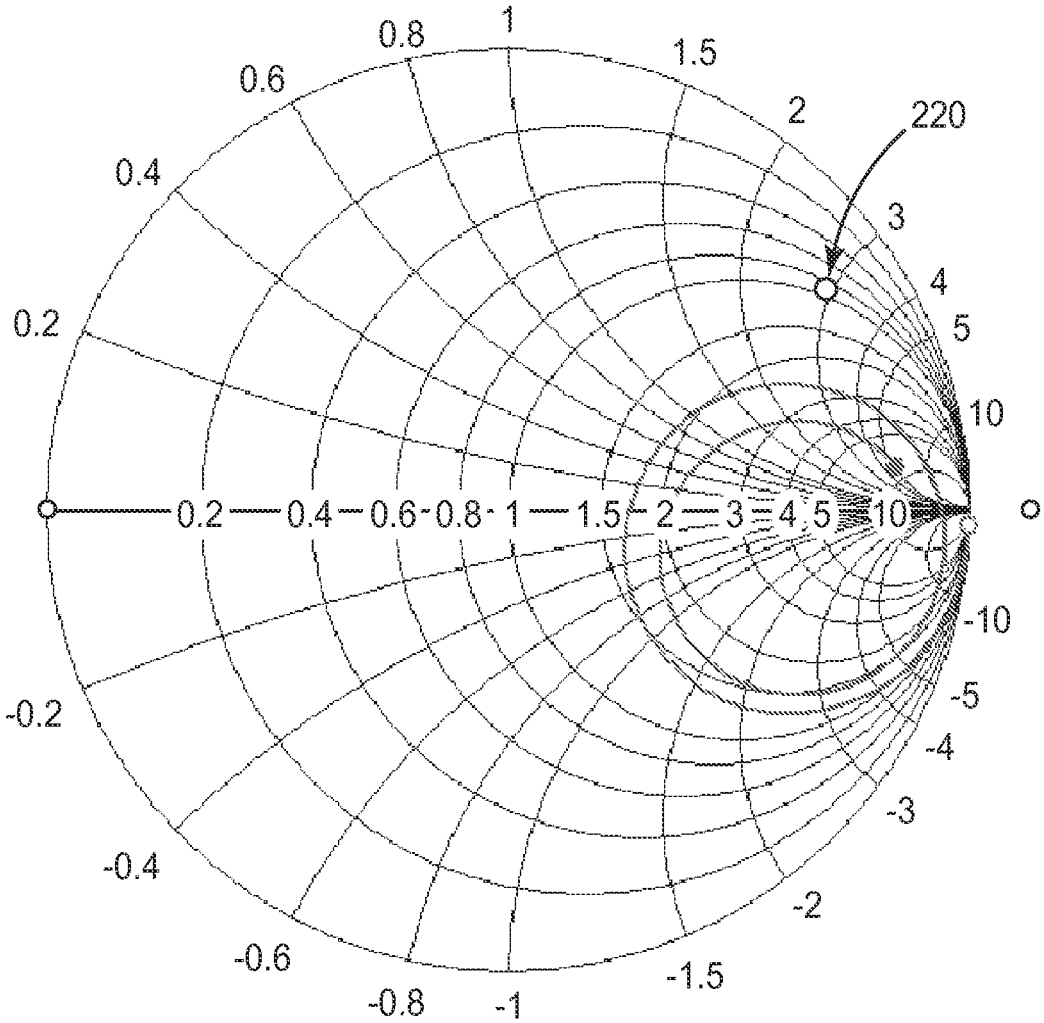
FIGS. 19A and 19B are Smith Charts that illustrate total impedance of a conventional dipole antenna and an antenna designed in accordance with the techniques of this disclosure.
Figure 19B:
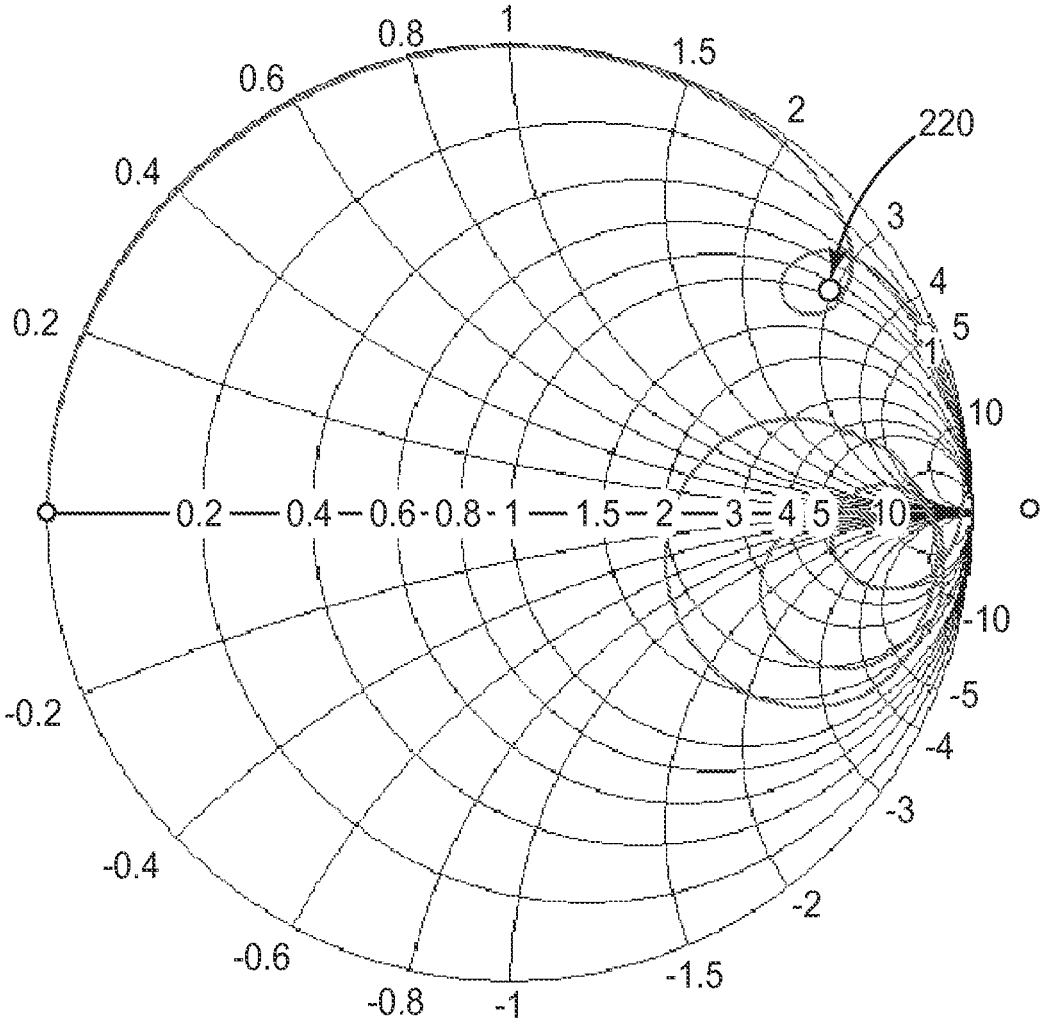

FIGS. 19A and 19B are Smith Charts that illustrate example total impedance of two antenna designs. In particular, FIG. 19A illustrates a Smith Chart of the total impedance of a conventional dipole antenna, i.e., without a loop segment. FIG. 19B illustrates a Smith Chart of the total impedance of a modified antenna that includes a loop segment as described in detail above. In FIGS. 19A and 19B, point 220 illustrates a desired region for optimal impedance matching for an example IC chip. As illustrated in FIG. 19A, the conventional dipole antenna does not achieve the required inductance to match the example IC chip. As illustrated in FIG. 19B, however, the impedance of the modified dipole antenna may be adjusted according to any of the several methods described above to achieve the impedance of the example IC chip.

Various embodiments have been described. These and other embodiments are within the scope of the following claims.

The invention claimed is:

1. A dipole antenna for a radio frequency identification (RFID) tag comprising:

a straight dipole segment formed from a first electrically conductive trace; and a loop segment formed from a second electrically conductive trace and electrically coupled to the straight dipole segment, wherein the width of the dipole antenna is less than or equal to four times the width of a smaller width of one of the first and second conductive traces.

2. The dipole antenna of claim 1, wherein the loop segment is symmetrically located along the straight dipole segment such that the straight dipole segment extends past the loop segment an equal distance in both directions.

3. The dipole antenna of claim 1, wherein the loop segment is asymmetrically located along the straight dipole segment such that a first portion of the straight dipole segment extends a further distance past the loop segment in a first direction than a second portion of the straight dipole antenna extends past the loop segment in an opposite direction.

4. The dipole antenna of claim 1, wherein the straight dipole segment includes folded segments that fold to form a folded dipole segment.

5. The dipole antenna of claim 1, wherein the width of the dipole antenna is less than approximately 6 millimeters (mm) and a length of the dipole antenna is greater than approximately 100 mm.

6. The dipole antenna of claim 5, wherein the width of the dipole antenna is less than or equal to approximately 4 mm.

7. The dipole antenna of claim 5, wherein the length of the dipole antenna is between approximately 125 mm and 150 mm.

8. The dipole antenna of claim 7, wherein the length of the dipole antenna is between approximately 130 mm and 135 mm.

9. The dipole antenna of claim 1, wherein the dipole antenna is configured to operate in an ultra high frequency (UHF) band of the radio spectrum.

10. The dipole antenna of claim 1, wherein at least one of the first and second conductive traces has a trace width of approximately 1 mm.

11. A radio frequency identification (RFID) tag comprising:

a modified dipole antenna that includes:

a straight dipole segment formed from a first electrically conductive trace; and a loop segment formed from a second electrically conductive trace and electrically coupled to the straight dipole segment, wherein the width of the modified dipole antenna is less than approximately 6 millimeters (mm) and a length of the modified dipole antenna is greater than 100 mm; and an integrated circuit electrically coupled to the modified dipole antenna.

12. The RFID tag of claim 11, wherein the width of the modified dipole antenna is less than or equal to approximately 4 mm.

13. The RFID tag of claim 11, wherein the width of the modified dipole antenna is less than or equal to four times a width of a smaller one of the first and second conductive traces.

14. The RFID tag of claim 11, wherein the loop segment is symmetrically located along the straight dipole segment such that the straight dipole segment extends past the loop segment an equal distance in both directions.

15. The RFID tag of claim 11, wherein the loop segment is asymmetrically located along the straight dipole segment such that a first portion of the straight dipole segment extends a further distance past the loop segment in a first direction than a second portion of the straight dipole antenna extends past the loop segment in an opposite direction.

16. The RFID tag of claim 11, wherein the straight dipole segment includes folded segments that fold to form a folded dipole segment.

17. The RFID tag of claim 11, further comprising at least one adhesive layer on at least one surface of the RFID tag.

18. The RFID tag of claim 11, wherein the length of the modified dipole antenna is between approximately 130 mm and 135 mm.

19. The RFID tag of claim 11, wherein the integrated circuit is electrically coupled to the modified dipole antenna within the loop segment of the modified dipole antenna.

20. The RFID tag of claim 11, wherein the integrated circuit is electrically coupled to the modified dipole antenna within the straight dipole segment of the modified dipole antenna.

21. The RFID tag of claim 11, wherein a width of the RFID tag is less than approximately 10 mm.

22. The RFID tag of claim 21, wherein the width of the RFID tag is less than approximately 7 mm.

23. The RFID tag of claim 22, wherein the width of the RFID tag is approximately equal to the width of the modified dipole antenna.

24. The RFID tag of claim 11, wherein the modified dipole antenna is configured to operate in an ultra high frequency (UHF) band of the radio spectrum.

25. The RFID tag of claim 11, wherein at least one of the first and second conductive traces has a trace width of approximately 1 mm.

* * * * *